US010800598B1

(12) United States Patent
Kent et al.

(10) Patent No.: US 10,800,598 B1
(45) Date of Patent: Oct. 13, 2020

(54) PACKAGING FOR GARMENT ON HANGER

(71) Applicant: Amazon Technologies, Inc., Seattle, WA (US)

(72) Inventors: Alexander Kent, Seattle, WA (US); Mike Custer, St. Charles, IL (US); Chad Hockin, Seattle, WA (US); Brent Lindberg, St. Charles, IL (US); Justine Lea Mahler, Seattle, WA (US); Jenna Walsh, St. Charles, IL (US)

(73) Assignee: Amazon Technologies, Inc., Seattle, WA (US)

( * ) Notice: Subject to any disclaimer, the term of this patent is extended or adjusted under 35 U.S.C. 154(b) by 272 days.

(21) Appl. No.: 15/610,508

(22) Filed: May 31, 2017

(51) Int. Cl.

| | |
|---|---|
| ***B65D 85/18*** | (2006.01) |
| ***B65B 25/20*** | (2006.01) |
| ***B65B 43/10*** | (2006.01) |
| ***B65B 7/24*** | (2006.01) |
| ***B65D 5/02*** | (2006.01) |
| ***B65D 5/10*** | (2006.01) |
| ***B65D 5/42*** | (2006.01) |
| ***B65D 5/50*** | (2006.01) |

(52) U.S. Cl.
CPC ..... *B65D 85/185* (2013.01); *B65B 7/24* (2013.01); *B65B 25/20* (2013.01); *B65B 43/10* (2013.01); *B65D 5/0254* (2013.01); *B65D 5/103* (2013.01); *B65D 5/4266* (2013.01); *B65D 5/5016* (2013.01); *B65D 85/18* (2013.01)

(58) Field of Classification Search
CPC .. B65D 85/185; B65D 85/182; B65D 5/0254; B65D 5/103; B65B 7/24
USPC ..... 206/292, 299, 297, 284; 229/120.18, 229/120.21
See application file for complete search history.

(56) References Cited

U.S. PATENT DOCUMENTS

| | | | | |
|---|---|---|---|---|
| 1,731,996 A * | 10/1929 | Appelbaum | B65D 85/18 206/288 |
| RE18,477 E * | 5/1932 | Appelbaum | |
| 3,664,572 A * | 5/1972 | Puchkoff et al. | B65D 5/18 229/103.2 |
| 5,439,107 A * | 8/1995 | Penet | B65D 5/5004 206/292 |
| 6,237,761 B1 * | 5/2001 | Godshaw | A45C 3/004 206/278 |

(Continued)

FOREIGN PATENT DOCUMENTS

| | | |
|---|---|---|
| GB | 333735 | * 8/1930 |
| GB | 568256 | * 3/1945 |

*Primary Examiner* — Sue A Weaver
(74) *Attorney, Agent, or Firm* — BakerHostetler

(57) ABSTRACT

A container includes a single piece of material having panels that are foldable about pre-formed crease lines into an enclosed configuration. The panels include a first base panel for supporting a garment and an insert panel extending from the first base panel and configured to be inserted within the garment. The insert panel is foldable to position the garment over the first base panel. The panels include sidewall panels, a second base panel, and a closure panel. The sidewall panels are foldable relative to the first base panel to form sidewalls of the container. The second base panel extends from one of the sidewall panels and is foldable over the first base panel. The closure panel extends from one of the panels, is foldable relative to the sidewall panels, and carries a fastener for fastening to another one of the panels to maintain the container in the enclosed configuration.

18 Claims, 19 Drawing Sheets

(56) References Cited

U.S. PATENT DOCUMENTS

| | | | | |
|---|---|---|---|---|
| 2002/0130055 | A1* | 9/2002 | Morrison, Jr. ..... | B65D 73/0078<br>206/297 |
| 2008/0093258 | A1* | 4/2008 | Kim ..... | B65D 5/0227<br>206/769 |

* cited by examiner

PACKAGING FOR GARMENT ON HANGER

BACKGROUND

In clothing retail, garments such as shirts, suits, and dresses, for example, are often displayed on hangers on a display rack in a retail store. Such clothing articles are typically referred to as "Garment on Hanger" (GOH) items. Much like a retail setting, when GOH items are offered for sale through ecommerce, such items are typically stored on a hanger prior to purchase at a fulfillment center. But storing GOH items in this fashion limits the options for storing, sorting, conveying, and picking of GOH items. Additionally, GOH items sometimes have low storage density in a fulfillment center.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

When conventional Garment on Hanger (GOH) items are processed in a fulfilment center, the GOH item is stored along with other GOH items on a hanger rack. This storage mechanism is inefficient for multiple reasons. For example, hanger racks typically require relatively large storage space in a fulfilment center. Additionally, moving GOH items from hanger racks and into shipping containers often requires multiple aspects of manual manipulation. When the GOH item is ordered, a picker in a conventional fulfillment center typically manually pulls the item from a hanger rack. After the GOH item is pulled, the picker or a packer manually places the GOH item in a box for shipping. These manual processes typically occur regardless of the time the GOH item spent on the hanger in the fulfilment center.

The present application describes containers and methods that may be employed to enable GOH items to be received at a fulfillment center from the manufacturer or like vendor already placed in a "Ship in Own Container" (SIOC) packaging containers. Relative to storing on hanger racks, these SIOC packaging containers can improve the efficiency in which GOH items are received, processed, stored, and delivered. These packaging containers can also better utilize storage space within the fulfilment center. SIOC for GOH items can also provide branding opportunities for the manufacturer and/or retailer. For example, SIOC packages can include a colorful internal liner that is designed to present the garment(s) in a new, vibrant manner to the customer upon opening the package. The SIOC package can also contain branding materials, such as logos, slogans, patterns, designs, and formatted instructions on either or both of the liner and the outer surface. Additionally, SIOC packages can be sized and tailored to match particular styles of garments, and can provide various enclosures and/or supports for particular portions of the garment. Such size tailoring can also help reduce the size of the SIOC package for shipping while also providing support and/or protection to the garment inside.

Figure 1:
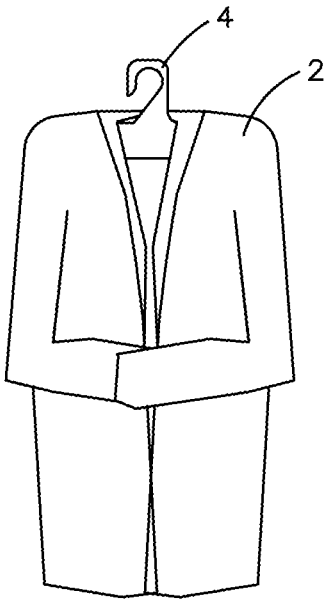
FIG. 1 shows a front view of a garment placed on a reconfigurable hanger insert.
Figure 2:
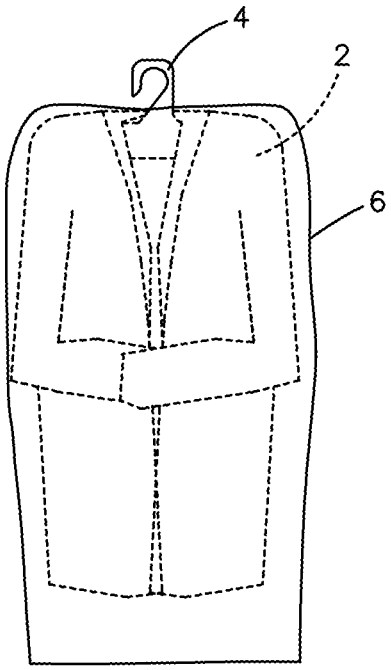
FIG. 2 shows a front view of the garment of FIG. 1 placed in a protective bag.

Referring to FIG. 1, a garment 2 is shown for use with a packaging container. The garment 2 can be positioned on a hanger insert 4 and can be any type of garment that is characterized as a GOH item. In FIG. 2, the garment 2 is shown disposed in a garment bag 6. It is to be appreciated that the term "garment", as used herein, can refer to the garment 2 by itself or in combination with the hanger 4 and/or a plastic wrap or garment bag 6.

Figure 3:
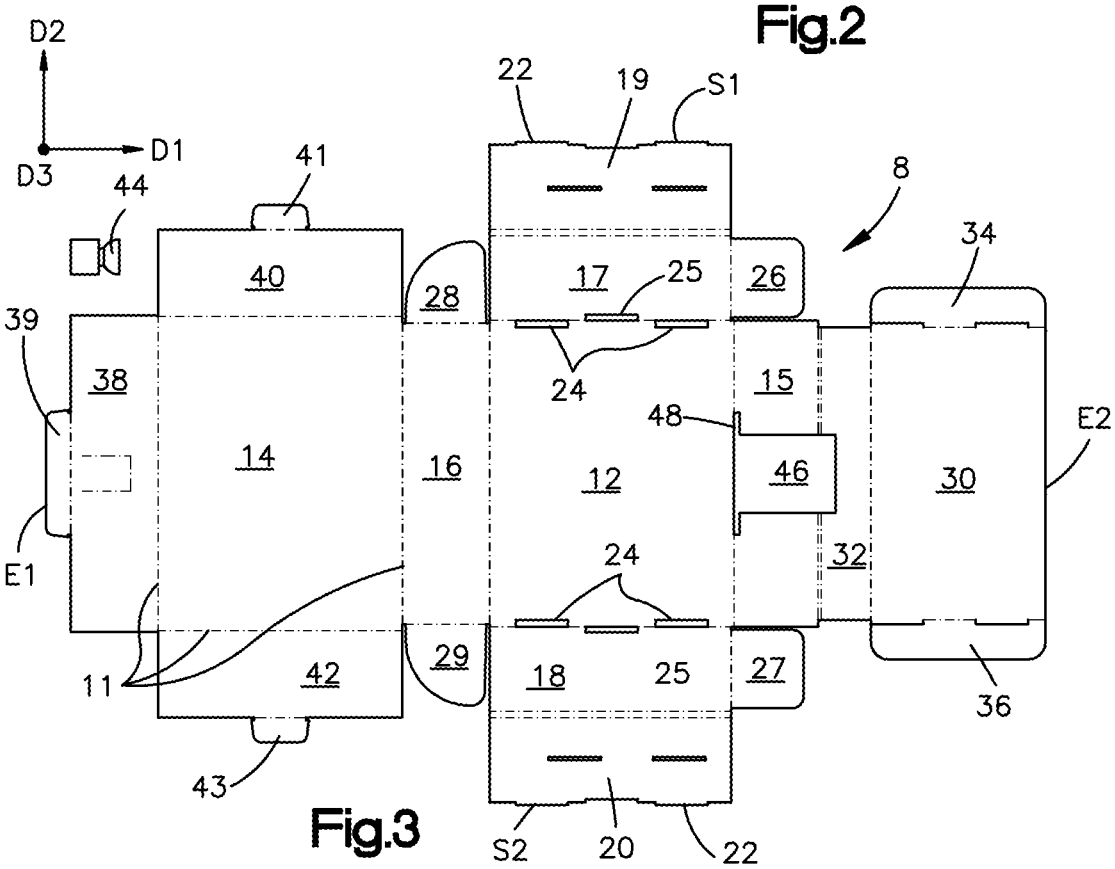
FIG. 3 shows a plan view of a container in an initial, open configuration, according to one embodiment.

Referring to FIG. 3, a container 8 is shown according to a first embodiment of the disclosure. The container 8 can be configured to be folded into a single-piece SIOC package. The container 8 is shown in an initial configuration, in which the container 8 is substantially flat, such as after a die cutting process, which initial configuration can also be termed a fully-open configuration. The container 8 can be formed of a material, such as paperboard, cardboard (such as corrugated fiberboard, also referred to as "corrugated board"), other paper-based board materials, or a plastic or sheet metal, by way of non-limiting example. The container 8 can be formed of a one or more preformed pieces of material, and preferably is die cut as a single piece. As shown in FIG. 3, the container 8 is a single piece of material 10, referred to herein as a "board," that is substantially flat or planar when in the fully open configuration. The board 10 can extend along a first direction D1 between a head end E1 and a foot end E2. The first direction D1 can be characterized as a longitudinal direction. The board 10 can also extend between first and second lateral sides S1, S2 along a second direction D2 that is substantially perpendicular to the first direction D1. The second direction can be characterized as a lateral direction. As shown, the board 10 can be symmetrical with respect to the second direction D2, although other configurations are within the scope of the present disclosure.

The board 10 can define a plurality of joined panels that are foldable relative to one another along pre-formed crease lines 11 so as to reconfigure the container 8 from the fully open configuration to a fully enclosed configuration that is ready for shipping. The crease lines 11 can be formed in the board 10 at boundaries between the foldable panels. The board 10 can define a first base panel 12 and a second base panel 14 spaced from each other along the first direction D1. One or both of the base panels 12, 14 can be configured to support the garment 2. The base panels 12, 14 can be foldable relative to each other so as to overlay one another with respect to a third direction D3 that is substantially perpendicular to the first and second directions D1, D2. The third direction can be characterized as a vertical direction. For reference, in the view of FIG. 3, the third direction D3 extends into and out of the page. The base panels 12, 14 can be the preferred horizontally-oriented bottom and top panels when the container 8 is in the fully enclosed configuration and stacked for shipping.

The board 10 can include a plurality of sidewall panels 15, 16, 17, 18 that are configured to fold to orthogonal orientations relative to the base panels 12, 14 to form sidewalls of the container 8 when the container 8 is in the fully enclosed configuration. A first sidewall panel 15 and a second sidewall panel 16 can be positioned on opposite sides of the first base panel 12 with respect to the first direction D1. The second sidewall panel 16 can extend between the base panels 12, 14 along the first direction D1. Third and fourth sidewall panels 17, 18 can be positioned on opposite sides of the first base panel 12 with respect to the second direction D2. The board 10 can also include a fifth sidewall panel 19 extending outwardly from the third sidewall panel 17 along the second direction D2 and a sixth sidewall panel 20 extending outwardly from the fourth sidewall panel 18 along the second direction D2. The fifth and sixth sidewall panels 19, 20 can be foldable relative to the third and fourth sidewall panels 17, 18, respectively, so as to double over the third and fourth sidewall panels 17, 18, respectively, when the container 8 is in the fully enclosed configuration. External sides of the fifth and sixth sidewall panels 19, 20 can define attachment features, such as tabs or protrusions 22, that are configured to be inserted within slots 24 formed in the first base panel 12 so as to maintain the fifth and sixth sidewall panels 19, 20 in the doubled-over position. The slots 24 can be formed at the crease lines 11 between the first base panel 12 and the third and fourth sidewall panels 17, 18, respectively. A closure slot 25 can be formed in each of the third and fourth sidewall panels 17, 18 at the respective crease lines 11 between third and fourth sidewall panels 17, 18 and the first base panel 12.

With continued reference to FIG. 3, the board 10 can include a pair of fold tabs 26, 27 extending from the third and fourth 17, 18 sidewall panels along the second direction D2 toward the foot end E2 of the board 10, but are not extending from the lateral sides of panel 15, and thus can stiffen the structure when folded upright as explained below. The board 10 can include a pair of insert tabs 28, 29 extending from opposite sides of the second sidewall panel 16 with respect to the second direction D2. In the illustrated embodiment, the insert tabs 28, 29 do not extend from the third or fourth sidewall panels 17, 18 (or from the second and third closure panels 40, 42 discussed below), and thus can stiffen the structure when folded as explained below.

The board 10 preferably includes a divider panel 30 and a connector panel 32 connecting the divider panel 30 to the first sidewall panel 15. Alternatively, the diver panel 30 and the connector panel 32 can extend from the second or third sidewall panel 17, 18 or another panel of the board 10. With continued reference to FIG. 3, the connector panel 32 and divider panel 30 can each be configured to fold over the first sidewall panel 15 so as to overlay the first base panel 12. The second base panel 14 is foldable so as to overlay the divider panel 30 and the first base panel 12 when the container 8 is in the fully enclosed configuration. The board 10 can include a pair of support panels 34, 36 extending from opposite sides of the divider panel with respect to the second direction D2. The support panels 34, 36 can fold to orthogonal orientations relative to the divider panel so as to maintain an enclosure height between the divider panel 30 and the first base panel 12 when the container 8 is in the fully enclosed configuration, as set forth in more detail below.

The board 10 can include a first closure panel 38 extending outwardly from the second base panel 14 along the first direction D1. The first closure panel can include a fastener, such as a closure tab 39. The board 10 can also include second and third closure panels 40, 42 extending from opposite sides of the second base panel 14 with respect to the second direction D2. The second and third closure panels 40, 42 can include respective fasteners, such as closure tabs 41, 43, that are configured to insert within the slots 25 in the third and fourth sidewall panels 17, 18 when the container is in the fully enclosed configuration.

The board 10 can include an optional attachment feature for gripping at least a portion of the garment 2 in a manner providing increased positional support to the garment 2. For example, the gripping feature can be a hanger hook insert 44 that is secured by an adhesive to the first closure panel 38. In other embodiments, the gripping feature can be a tab that is integral with the first closure panel 38 and bendable so as to be hooked by the hanger insert 4. The gripping feature can alternatively be located on the second base panel 14. The board 10 can include an aperture 46 formed through the first sidewall panel 15 and a portion of the connector panel 32. The first sidewall panel 15 can also define a slot 48 extending along the crease line 11 between the first sidewall panel 15 and the first base panel 12.

Figure 4:
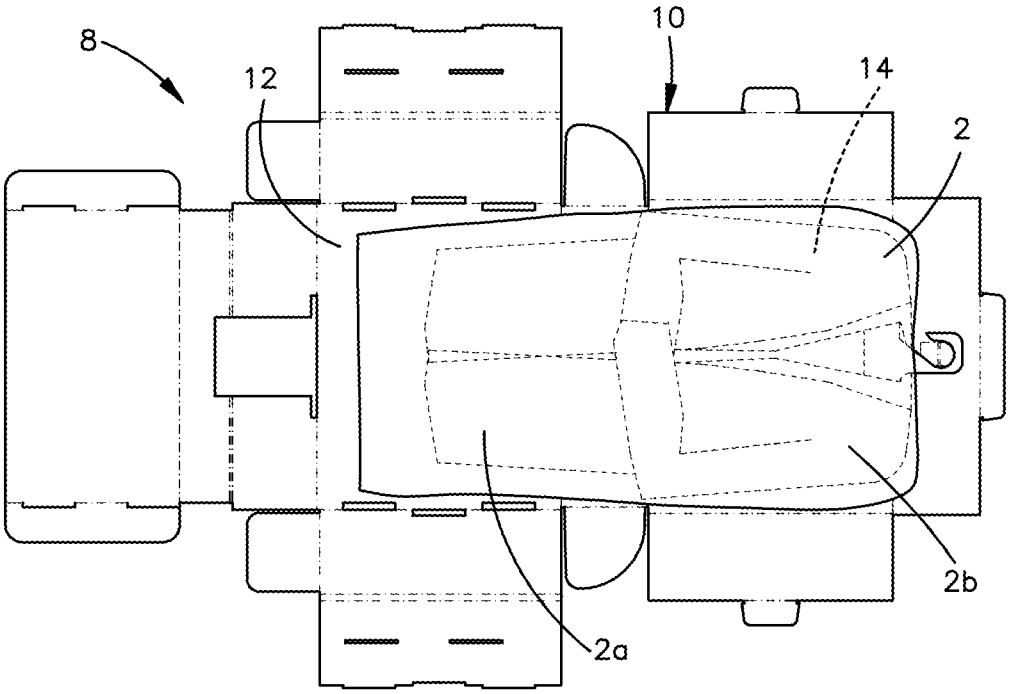
FIG. 4 shows a plan view of a packaging assembly that includes the garment of FIG. 2 disposed on the container of FIG. 3.
Figure 5:
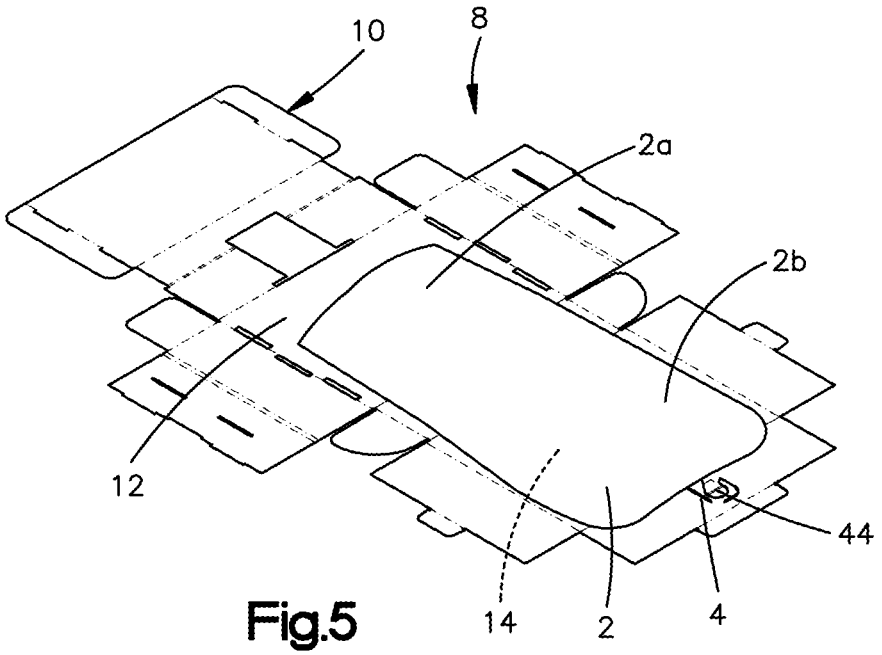
FIG. 5 shows a perspective view of the packaging assembly of FIG. 4.

Referring now to FIGS. 4 and 5, at the commencement of a process for packaging the garment 2 within the container 8, the garment 2 can be placed on the board 10 so that a first portion 2*a* of the garment 2 is supported by the first base panel 12 and a second portion 2*b* of the garment 2 is supported by the second base panel 14. The hanger hook insert 44 can be configured to be hooked by the hanger 4 so as to secure the garment 2 to the closure panel 38. The coupling of the hanger insert 4 to the hanger hook insert 44 can also support the garment 2 against shifting or bunching along the longitudinal and lateral directions D1, D2 during packaging, shipping, storage, or delivery of the container 8.

Figure 6:
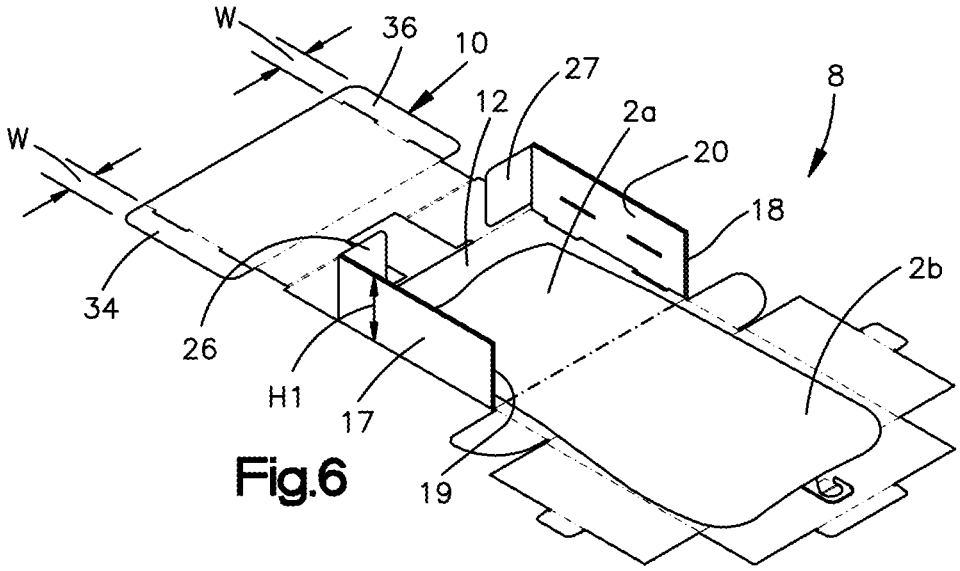
FIG. 6 shows a perspective view of the packaging assembly of FIG. 4, wherein the container is folded to a first partially folded configuration.

Referring now to FIG. 6, the board 10 may be folded to a first partially folded configuration by folding the third and fourth sidewall panels 17, 18 to an orthogonal orientation relative to the first base panel 12, doubling the fifth and sixth sidewall panels 19, 20 inward over the third and fourth sidewall panels 17, 18, respectively, and inserting the projections 22 of the fifth and sixth sidewall panels 19, 20 into the associated slots 24 of the first base panel 12. The fold tabs 26, 27 can each be folded to an orthogonal orientation relative to the respective third and fourth sidewall panels 17, 18. In this position, the fold tabs 26, 27 can extend along the crease line 11 at the periphery of the first base panel 12. The third and fourth sidewall panels 17, 18 can each define a height H that can at least approximate the final height of the container 8 in the fully enclosed configuration.

Figure 7:
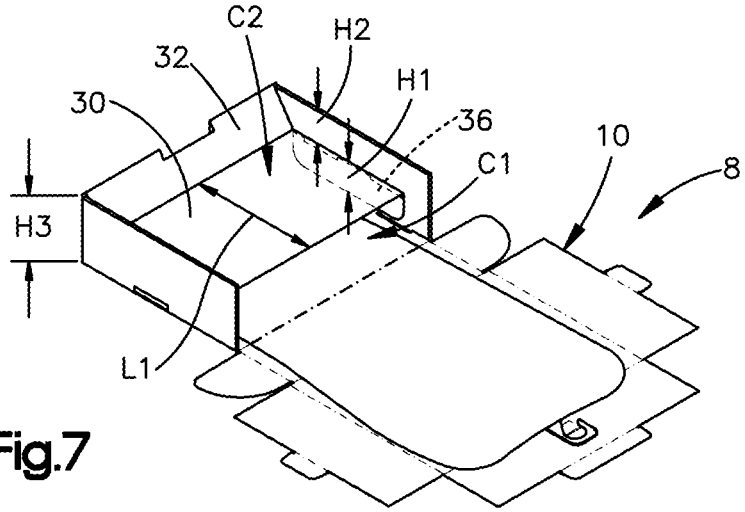
FIG. 7 shows a perspective view of the packaging assembly of FIG. 4, wherein the container is folded to a second partially folded configuration.

Referring now to FIG. 7, the board 10 may be folded to a second partially folded configuration by folding the first sidewall panel 15 to an orthogonal orientation relative to the first base panel 12 so that an inner face of the first sidewall panel abuts outer faces of the fold tabs 26, 27. The support panels 34, 36 can be folded to an orthogonal orientation relative to the divider panel 30 and the divider panel 30 and the connector panel 32 can be folded so that the divider panel 30 overlies the first portion 2*a* of the garment 2 and at least a portion of the first base panel 12 with respect to the third direction D3. In this configuration, the connector panel 32 can be declined along the first direction D1 from the first sidewall panel 15 to the divider panel 30.

Figure 9:
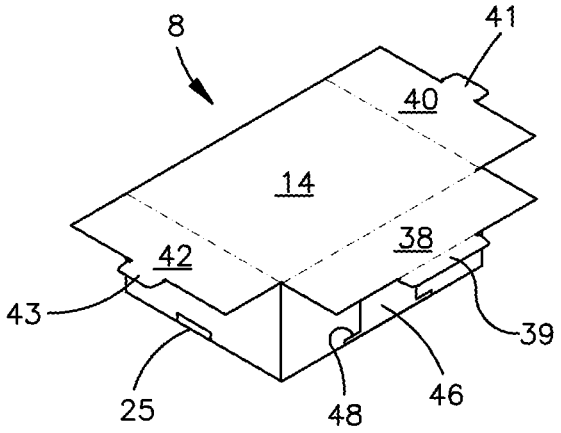
FIG. 9 shows a perspective view of the packaging assembly of FIG. 4, wherein the container is folded to a fourth partially folded configuration.

External ends of the support panels 34, 36 can abut the first base panel 12 so as to define a first compartment C1 within the container 8 that is sized to enclose the first portion 2*a* of the garment 2. FIG. 7 shows the first compartment C1 substantially as it will be when the container 8 is in the fully enclosed configuration. The width W of the support panels 34, 36 (FIG. 6) can be sized to provide the first compartment C1 with a height H1 which, in turn, can also define a height H2 of a second compartment C2 that will enclose the second portion 2*b* of the garment 2. The second compartment C1 can extend between the divider panel 30 and the second base panel 14 when the second base panel 14 is folded over the divider panel 32 (FIG. 9). Thus, by adjusting the width W of the support panels 34, 36, the respective heights H1, H2 of the first and second compartments C1, C2 can be tailored to a size that is large enough to prevent the first portion 2*a* of the garment 2 from deleteriously compressing or crushing while also reducing the overall height of the container 8 in the fully enclosed configuration. In this manner, the size of the fully enclosed container 8 can be reduced, which increases the storage and shipping density of such containers 8. It is to be appreciated that the compartments C1, C2 provide the merchant with a variety of options for shipping garments. For example, the compartments C1, C2 can be configured to carry separate garments. For example, a first garment can be placed in the first compartment C1 and a second garment can be placed in the second compartment C2.

Figure 8:
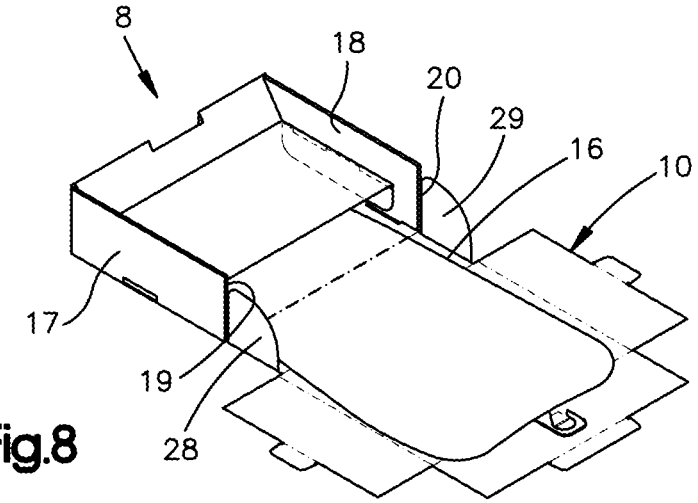
FIG. 8 shows a perspective view of the packaging assembly of FIG. 4, wherein the container is folded to a third partially folded configuration.

As shown in FIG. 8, the board 10 may be folded to a third partially folded configuration by folding the inset tabs 28, 29 to an orthogonal orientation relative to the second sidewall panel 16. The second sidewall panel 16 can be folded to an orthogonal orientation relative to the first base panel 12 and the first insert tab 28 can be inserted within a slot defined between the third and fifth sidewall panels 17, 19 and the second insert tab 29 can be inserted within a slot defined between the fourth and sixth sidewall panels 18, 20.

Figure 10:
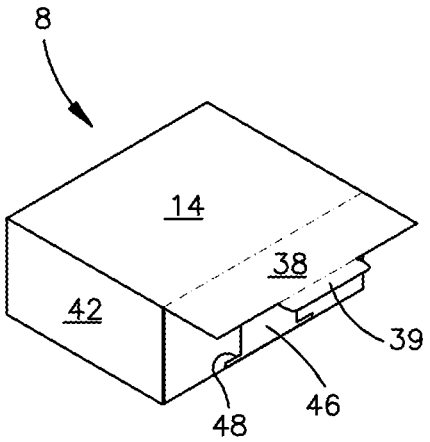
FIG. 10 shows a perspective view of the packaging assembly of FIG. 4, wherein the container is folded to a fifth partially folded configuration.

Referring now to FIGS. 9 and 10, the board 10 may be folded to fourth and fifth partially folded configuration, respectively. The second base panel 14 can be folded to a parallel orientation overlaying the first base panel 12 and the divider panel 30 in a manner folding the second portion of the garment 2*b* over the divider panel 30 and over the first portion of the garment 2*a*. In this manner, the first portion 2*a* of the garment 2 is enclosed within the first compartment C1 (FIG. 7), the second portion 2*b* of the garment 2 is enclosed within the second compartment (FIG. 7), and a third portion of the garment 2 bends around the edge laterally extending edge of the divider panel 30. In this regard, the configuration of the divider panel 30 provides for secure housing of the garment by ensuring that various portions of the garment remain in their intended place while housed in the container 8, which also can enhance presentation to the customer upon opening. For example, in the illustrated embodiment, certain fragile portions of the garment, such as shoulder pads within the second portion 2*b* of the garment 2, can remain protected within the second compartment C2 without being crushed, scraped, snagged, misshaped, or otherwise damaged by other portions of the garment 2 or by the container 8 itself. The length L1 of the divider panel 30 (FIG. 7) can be tailored as desired to provide beneficial bending and/or folding characteristics to the third portion of the garment 2.

It is to be appreciated that at least some of the panels, such as the sidewall panels 15, 16, 17, 18, for example, can define scoring or other features that provide such panels with a degree of size adjustability so as to allow the container 8 to achieve an adjustable fit to the garment folded within.

Figure 11:
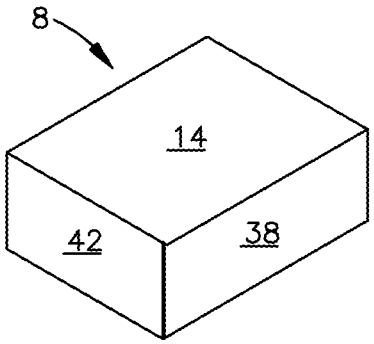
FIG. 11 shows a perspective view of the packaging assembly of FIG. 4, wherein the container is folded to a fully enclosed configuration.

The second and third closure panels 40, 42 can be folded against the third and fourth sidewall panels 17, 18 and the first closure panel 38 can be folded against the first sidewall panel 15. The closure tabs 39, 41, 43 can be inserted into the associated closure slots 48, 25 so as to maintain the container 8 in the fully enclosed configuration, as shown in FIG. 11. The aperture 46 in the first sidewall 15 can be sized to at least partially receive the hanger hook insert 44 (FIG. 5) attached to the first closure panel 38.

Figure 12:
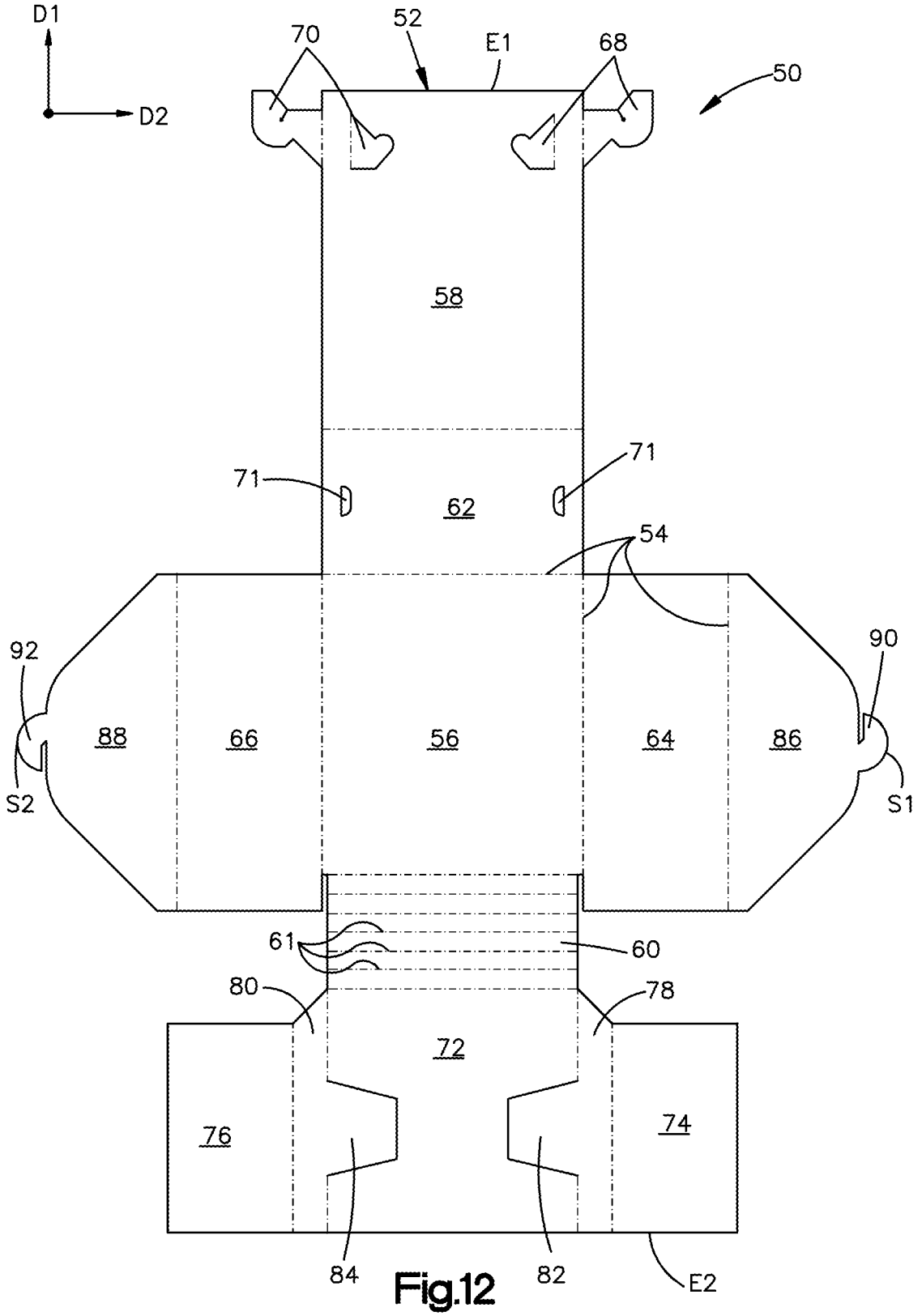
FIG. 12 shows a plan view of a container in an initial, open configuration, according to another embodiment.

Referring now to FIG. 12, a container 50 is shown according to a second embodiment of the disclosure. The container 50 preferably is a single panel that can be configured to be folded into a single-piece SIOC package. The container 50 of the second embodiment can be generally similar to the container 8 described above. Thus, it is to be appreciated that the features set forth above with respect to container 8 can also apply to container 50 unless otherwise set forth herein.

The container 50 can include a single-piece board 52 extending along a first or longitudinal direction D1 between a head end E1 and a foot end E2 and extending along a second or lateral direction D2 between first and second lateral sides S1, S2. The board 52 can be symmetrical with respect to the second direction D2, although other configurations are possible. The board 52 can define a plurality of joined panels that are foldable relative to one another along pre-formed crease lines 54 so as to reconfigure the container 50 from the fully open configuration to the fully enclosed configuration.

The board 52 can include a first base panel 56 and a second base panel 58 spaced from each other along the first direction D1. The board 52 can define first and second sidewall panels 60, 62 located on opposite longitudinal sides of the first base panel 56 and third and fourth sidewall panels 64, 66 located on opposite lateral sides of the first base panel 56. The first sidewall panel 60 can include scoring 61 allowing the first sidewall panel 60 to bend along a substantially curved profile. The second base panel 58 can define a first pair 68 and a second pair 70 of foldable tabs, wherein the tabs of each pair 68, 70 are foldable so as to interlock in a manner defining attachment features that are connectable to a garment, as set forth in more detail below. The second sidewall panel 62 can define a pair of slots 71 for receiving an attachment member, as set forth in more detail below.

The board 52 can include a first divider panel 72 extending along the first direction D1 from the first sidewall panel 60 toward the foot end E2. Alternatively, the first diver panel 72 can extend from the third or fourth sidewall panel 64, 66 or another panel of the board 52. With continued reference to FIG. 12, the board 52 can include second and third divider panels 74, 76 located on opposite lateral sides of the first divider panel 72. A fifth sidewall panel 78 can be positioned between the first and second divider panels 72, 74 and a sixth sidewall panel 80 can be positioned between the first and third divider panels 72, 76 along the second direction D2. The second and third divider panels 74, 76 can define respective first and second support tabs 82, 84 extending towards one another along the second direction D2 when the board 52 is in the fully open configuration. The board 52 can include a first closure panel 86 extending from the third sidewall panel 64 along the second direction D2 and a second closure panel 88 extending from the fourth sidewall 66 panel along the second direction D2. The closure panels 86, 88 can define respective fastener tabs 90, 92 configured to interlock with each, as set forth in more detail below.

Figure 13:
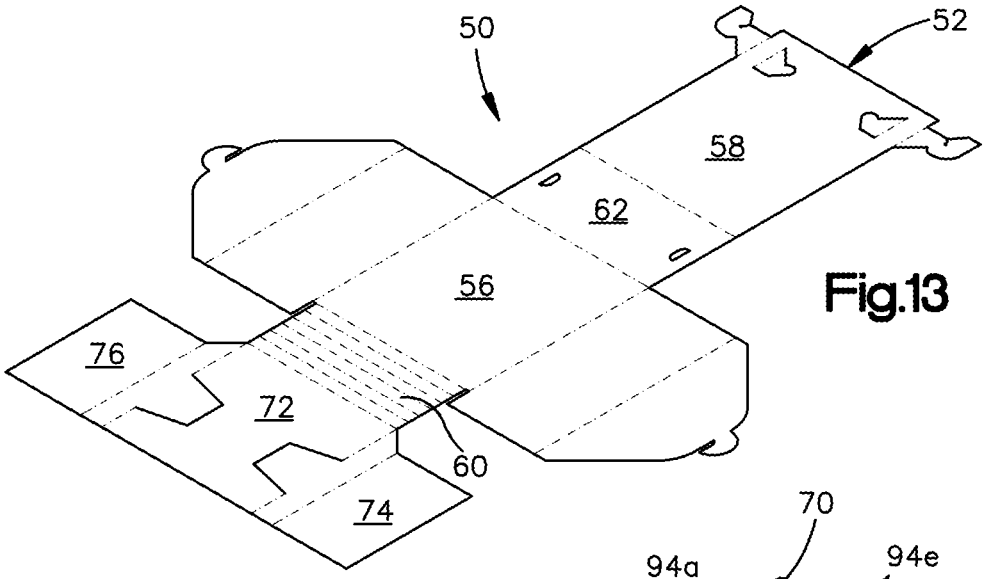
FIG. 13 shows a perspective view of the container of FIG. 12.
Figure 14:
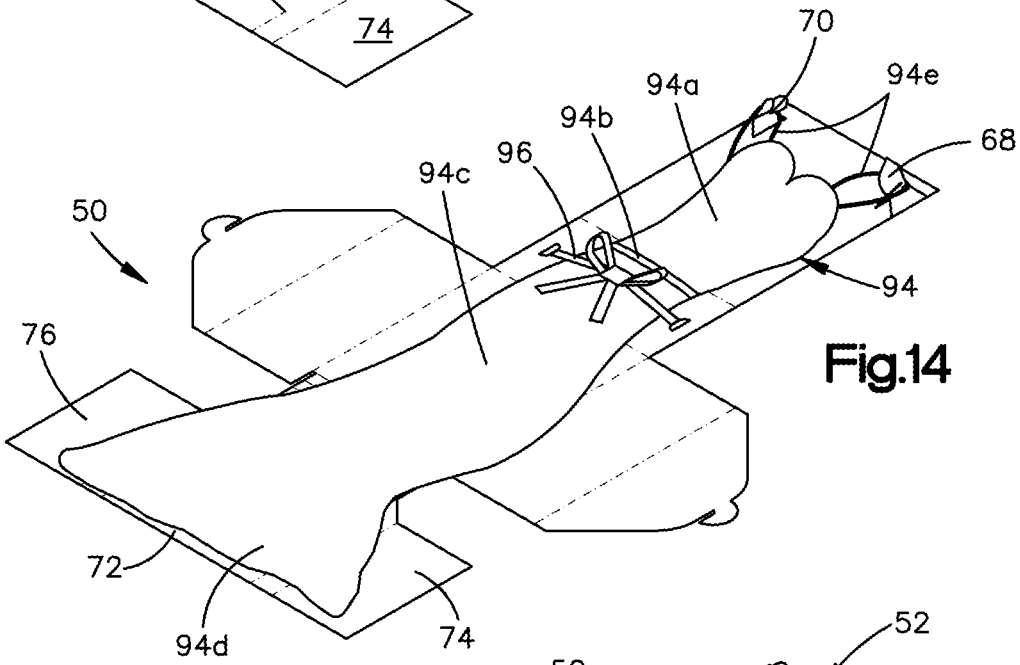
FIG. 14 shows a perspective view of a packaging assembly that includes a garment disposed on the container of FIG. 13.

Referring now to FIGS. 13 and 14, when packing a garment 94 in the container 50, the board 52 can be laid flat and the garment 94, such as a dress or gown, by way of non-limiting example, can be placed on the board 52. In the illustrated embodiment of the board 52 in the fully open configuration, a bodice 94*a* of the dress can generally overlay the second base panel 58, a waist 94*b* of the dress can generally overlay the second sidewall panel, and a skirt 94*c* of the dress can generally overlay the first base panel 56, the first sidewall panel 60, and the first, second, and third divider panels 72, 74, 76. The divider panels 72, 74, 76 can be sized to accommodate a foot 94*d* of the skirt 94*c*. The first and second pairs of tabs 68, 70 can each be folded and interlocked and shoulder straps 94*e* of the dress can be placed on the interlocked pairs of tabs 68, 70 to support the dress against shifting or bunching within the container 50. An attachment member, such as a strap 96, can be inserted through the slots 71 in the second sidewall panel 62 and can secure the dress thereto, further supporting the dress against bunching or shifting. The strap 96 can include an ornamental feature, such as a bow, for branding the dress and enhancing the customer experience. The strap 96 can also extend outside the container 50 (see FIG. 23) and can be configured in the form of a handle for removing the container from an outerbox and/or for carrying by the customer. Thus, the strap 96 can also provide additional ornamental qualities to the container that further enhances the customer experience.

Figure 15:
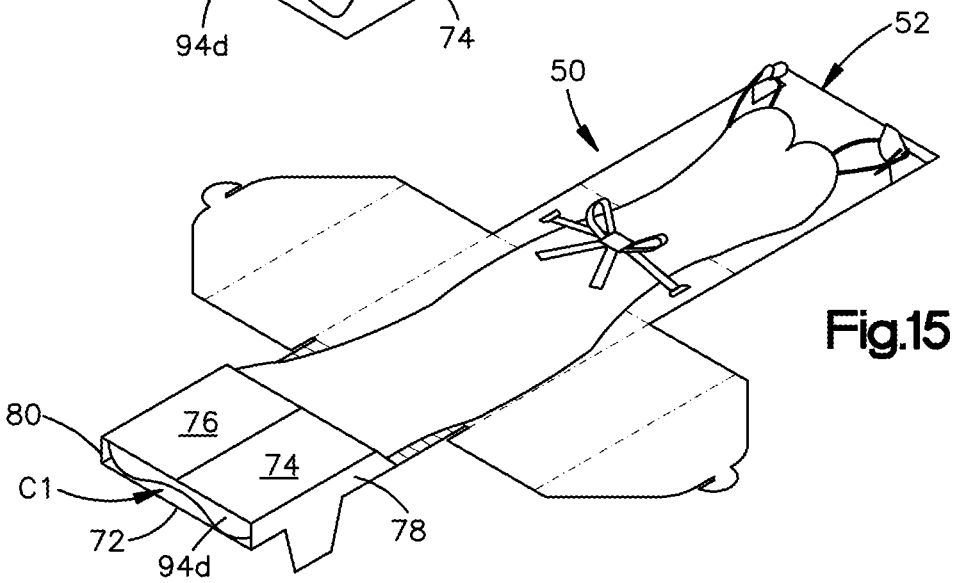
FIG. 15 shows a perspective view of the packaging assembly of FIG. 14, wherein the container is folded to a first partially folded configuration.

As shown in FIG. 15, the fifth and sixth sidewall panels 78, 80 can be folded to an orthogonal orientation relative to the first divider panel 72, and the second and third divider panels 74, 76 can be folded inward so as to overlay the first divider panel 72 in a manner defining a first compartment C1 of the container 50 for enclosing and protecting the foot 94*d* of the dress.

Figure 16:
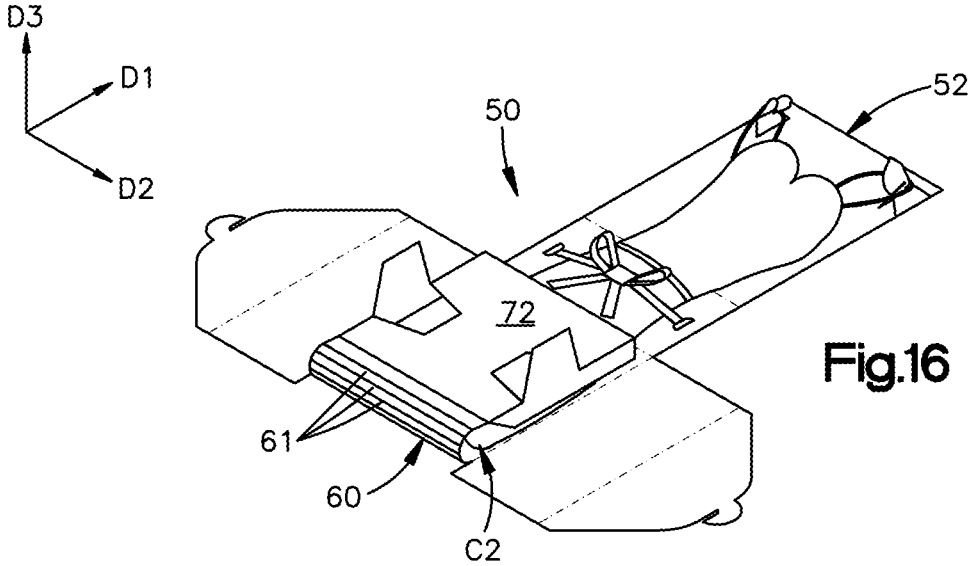
FIG. 16 shows a perspective view of the packaging assembly of FIG. 14, wherein the container is folded to a second partially folded configuration.

As shown in FIG. 16, the reconfigured divider panels 72, 74, 76 can be folded over the first base panel 56, with the support tabs 82, 84 extending vertically with respect to the first divider panel 72. The scoring 61 can provide the first base panel 56 with an adjustable bending profile. A second compartment C2 of the container 50 can be defined between the first base panel 56 and the folded second and third divider panels 74, 76. In additional embodiments, the container 50 can include additional support members, such as support tabs (not shown) extending downward from the fifth and sixth sidewall panels 78, 80 to the first base panel 56 in a manner for supporting and maintaining a height of the second compartment C2 along the third direction D3.

Figure 17:
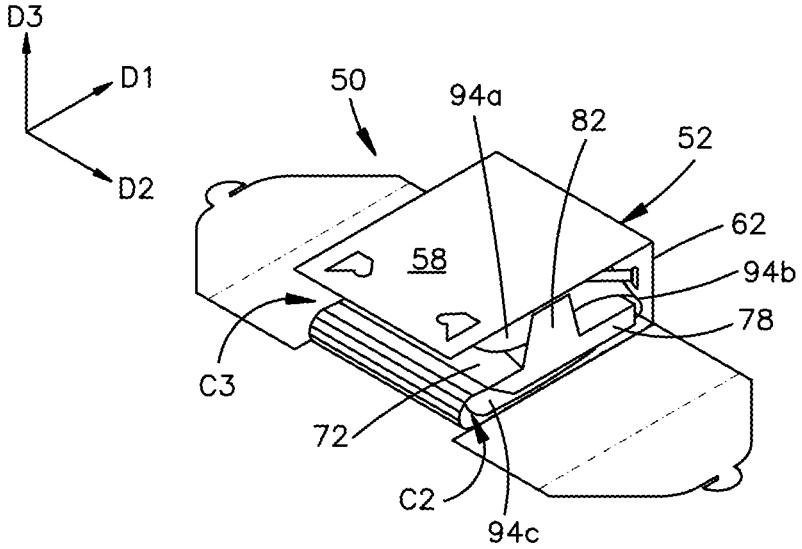
FIG. 17 shows a perspective view of the packaging assembly of FIG. 14, wherein the container is folded to a third partially folded configuration.

As shown in FIG. 17, the second sidewall panel 62 can be folded to an orthogonal orientation relative to the first base panel 56 and the second base panel 58 can be folded over the first base panel 56 until the second base panel 58 abuts external ends of the support tabs 82, 84. A third compartment C3 of the container 50 can be at least partially defined between the support tabs 82, 84, the first divider panel 72, and the second base panel 62. The support tabs 82, 84 can be configured to maintain a height of the third compartment C3 along the third direction D3 by supporting the second base panel 58. As shown, the container 50 can be configured such that the foot 94*d* of the skirt 94*c* can substantially be positioned in the first compartment C1 (FIG. 15), another portion of the skirt 94*c* can substantially be positioned in the second compartment C2, the bodice 94*a* of the dress can substantially be positioned in the third compartment C3, and the dress can be bent over the first divider panel 72 substantially at the waist. In this regard, the panels provide a means for repeatably folding the garment along its length. Additionally, the configuration of the divider panels 72, 74, 76 provides for secure housing of the garment by ensuring that various portions of the garment 94 remain in their intended place while housed in the container 50, which also can enhance presentation to the customer upon opening. In the illustrated embodiment, certain fragile portions of the garment, such as sequins, for example, can remain protected within the compartments C1, C2, C3 without being crushed, scraped, snagged, misshaped, or otherwise damaged by other portions of the garment 94 or by the container 50 itself. The panels can be tailored as desired to provide beneficial bending and/or folding characteristics to the garment 94.

Figure 18:
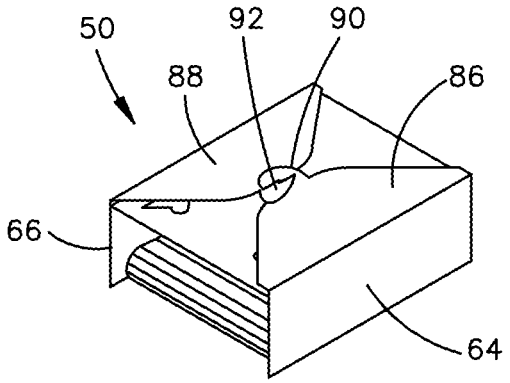
FIG. 18 shows a perspective view of the packaging assembly of FIG. 14, wherein the container is folded to a closed configuration.
Figure 19:
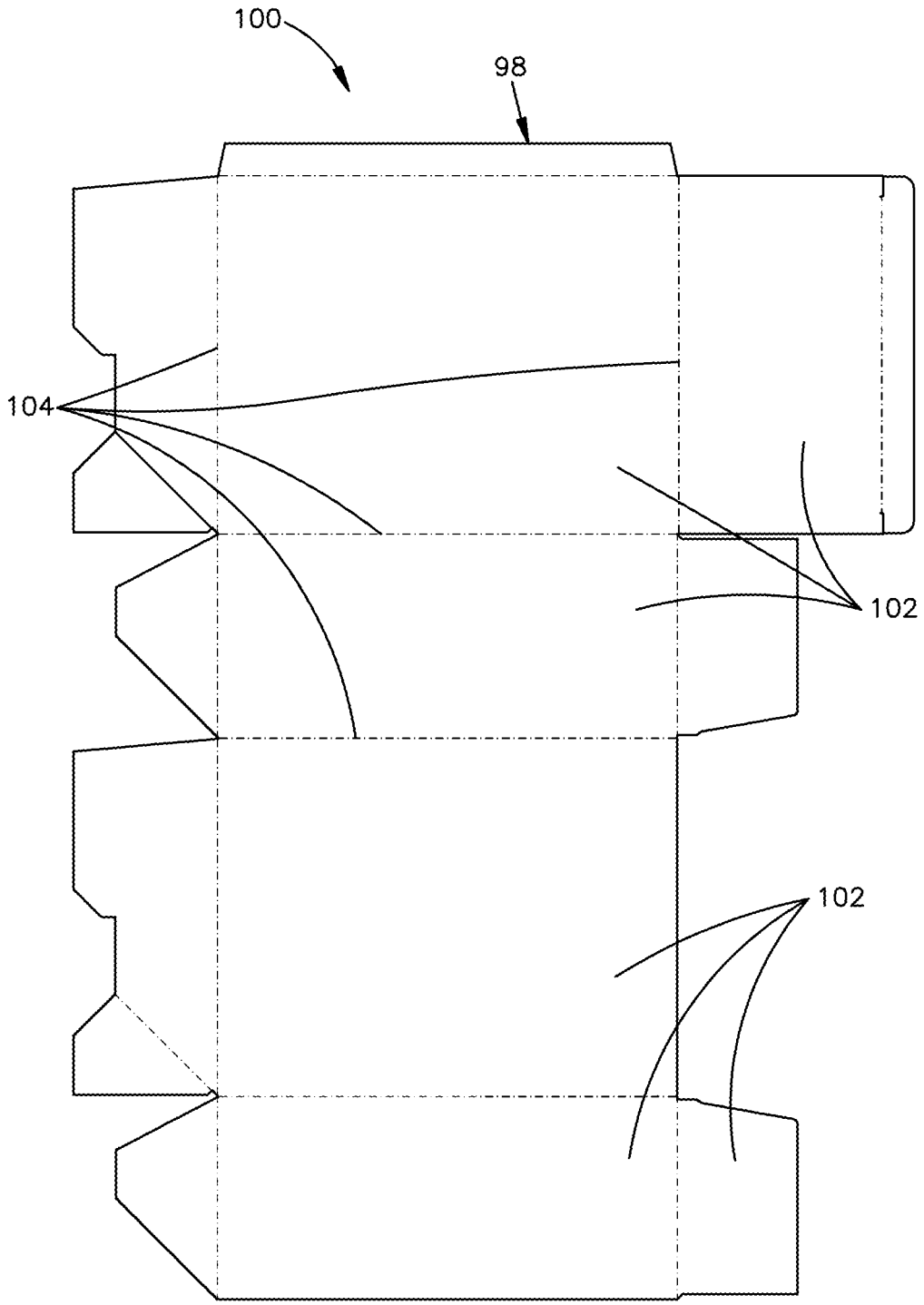
FIG. 19 shows a plan view of an outer container in an initial, open configuration, wherein the outer container is configured to enclose the container of FIG. 18 in the closed configuration.
Figure 22:
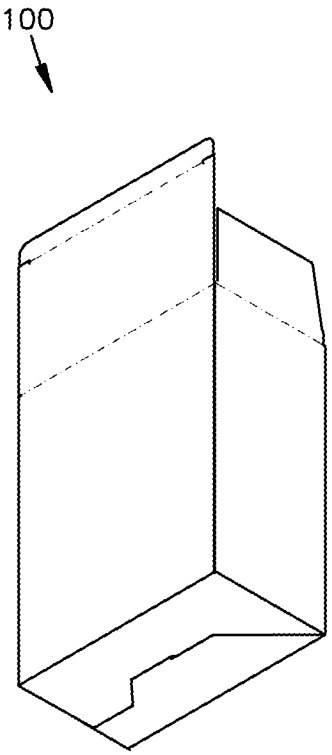
FIG. 22 shows a perspective view of the outer container of FIG. 19 in a third partially folded configuration.
Figure 21:
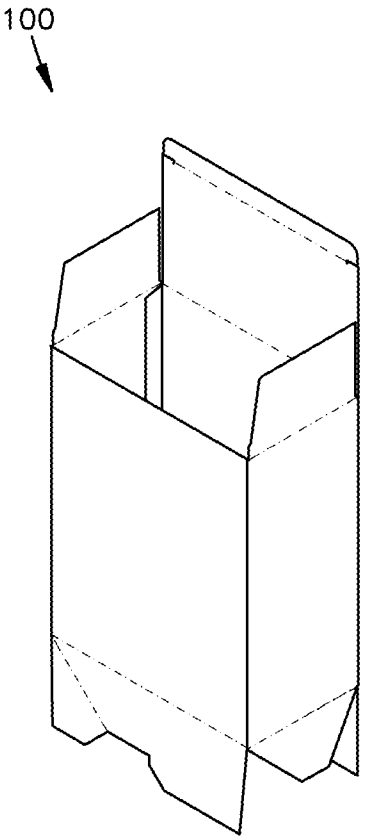
FIG. 21 shows a perspective view of the outer container of FIG. 19 in a second partially folded configuration.
Figure 20:
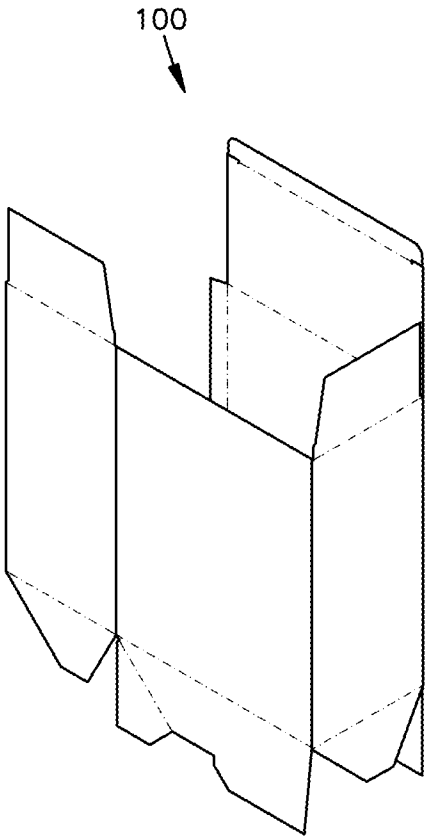
FIG. 20 shows a perspective view of the outer container of FIG. 19 in a first partially folded configuration.

As shown in FIG. 18, the third and fourth sidewall panels 64, 66 can be folded to an orthogonal orientation relative to the first base panel 56 and the first and second closure panels 86, 88 can be folded over the second base panel 58. The fastener tabs 90, 92 can be interlocked so as to fasten the closure panels 86, 88 together in a manner maintaining the container 50 in an enclosed configuration. In this embodiment, the container 50 is configured so that the customer must open the container 50 (at least in a non-destructive manner) by first unfastening the fastener tabs 90, 92 and unfolding the second base panel 58 along the first direction D1, which will immediately and prominently display the bodice 94*a* (which is often the most ornate and signifying portion of the dress), to the customer.

It is to be appreciated that at least some other panels, such as the second, third, and fourth sidewall panels 62, 64, 66, for example, can also define scoring or other features that provide such panels with a degree of size adjustability so as to allow the container 50 to achieve an adjustable fit to the garment folded within.

Figure 23:
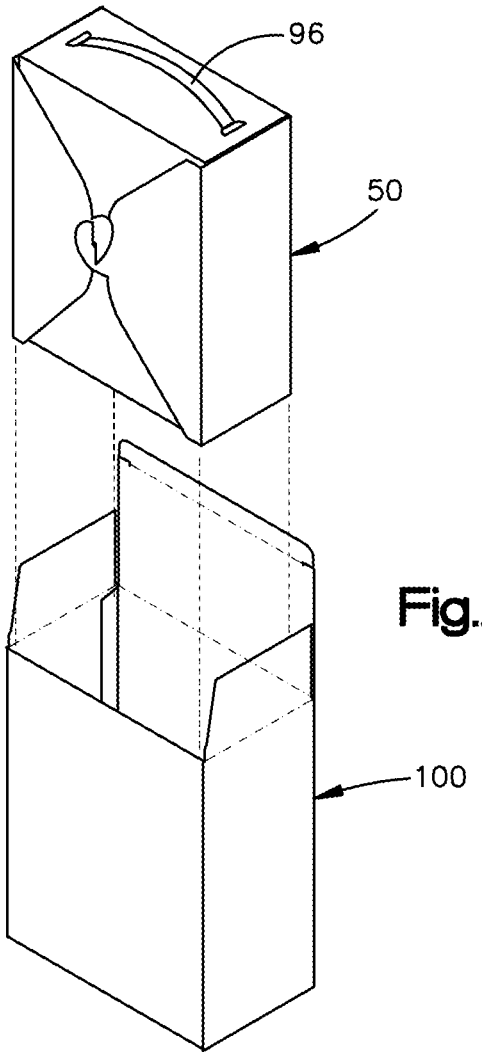
FIG. 23 shows a perspective view of the outer container of FIG. 19 in a fourth partially folded configuration configured to receive the container of FIG. 18 in the closed configuration.
Figure 24:
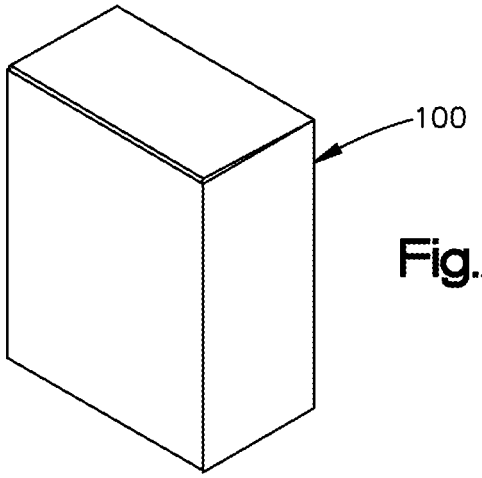
FIG. 24 shows a perspective view of the of the outer container of FIG. 19 in a fully enclosed configuration.

FIGS. 19 through 24 illustrates a board 98 of an optional outerbox 100 for carrying the container 50. In a similar manner as set forth above, the outer box board 98 can define a plurality of joined panels 102 that are foldable relative to one another along pre-formed crease lines 104 so as to reconfigure the outerbox 100 from the fully open configuration (FIG. 19) to a configuration (FIG. 22) that is ready to receive the container 50 (FIG. 23). After inserting the container 50 in the outerbox 100, final folds can be made to the outerbox 100 so as to place it in the fully enclosed configuration.

Figure 25:
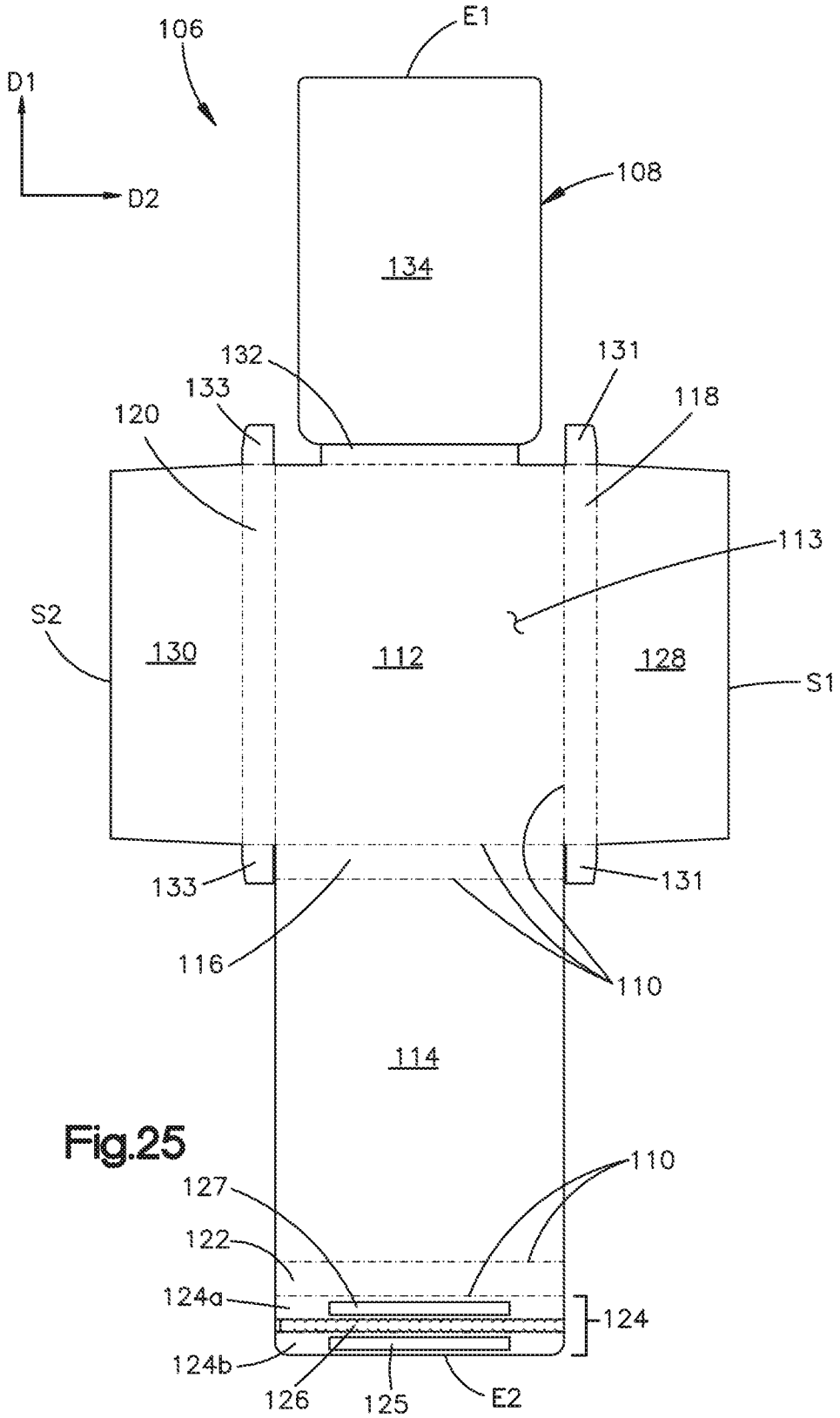
FIG. 25 shows a plan view of a container in an initial, open configuration, according to another embodiment.

Referring now to FIG. 25, a container 106 is shown according to a third embodiment of the disclosure. The container 106 can be configured to be folded into a single-piece SIOC package. The container 106 preferably include a single-piece board 108 extending along a first or longitudinal direction D1 between a head end E1 and a foot end E2 and extending along a second or lateral direction D2 between first and second lateral sides S1, S2. The board 108 can be symmetrical with respect to the second direction D2, although other configurations are possible. The board 108 can define a plurality of joined panels that are foldable relative to one another along pre-formed crease lines 110 so as to reconfigure the container 106 from a fully open configuration to a fully enclosed configuration.

In the illustrated embodiment, the board 108 includes a first base panel 112 and a second base panel 114 spaced from each other along the first direction D1. The first base panel 112 can define a support surface 113 for supporting a garment. In the present embodiment, the second base panel 114 can extend between the first base panel 112 and the foot end E2 of the board 108 with respect to the first direction D1. The board 108 can define a first sidewall panel 116 extending between the first and second base panels 112, 114 along the first direction D1. The board 108 can define second and third sidewall panels 118, 120 extending from opposite sides of the first base panel 112 with respect to the second direction D2. A fourth sidewall panel 122 can extend from the second base panel 114 toward the foot end E2 of the board 108.

A closure panel 124 can extend from the fourth sidewall panel 122 to the foot end E2 and can define a fastener for fastening to another panel of the board 108. For example, the fastener can include a first adhesive strip 125 extending along the second direction D2. The closure panel 124 can also define an opening feature, such as a perforated tear-away opening strip 126 extending along the second direction D2, for example. In other embodiments, the opening feature can include a tuck tab, a piece of tape, or another type of opening feature, by way of non-limiting example. The opening strip 126 can separate the closure panel 124 into a first and second portions 124*a*, 124*b* on opposite sides of the strip 126 with respect to the first direction D1. The foot end E2 of the board 108 can be defined by an exterior edge of the second portion 124*b* of the closure panel 124. The second portion 124*b* of the closure panel 124 can carry the first adhesive strip 125. The first portion 124*a* of the closure panel 124 can carry another fastener, such as a second adhesive strip 127, for fastening to another panel of the container 106 for return shipping. The first and second adhesive strips 125, 127 can be covered by respective removable coverings.

The board 108 can define a first fold-over panel 128 extending from the second sidewall panel 118 and a second fold-over panel 130 extending from the third sidewall panel 120 along the second direction D2 opposite the first fold-over panel 128. A first pair of support tabs 131 can extend along the first direction D1 from opposite ends of the second sidewall panel 118. A second pair of support tabs 133 can extend along the first direction D1 from opposite ends of the third sidewall panel 120.

The board 108 can define a spacer panel 132 extending from a side of the first base panel 112 opposite the first sidewall panel 116 with respect to the first direction D1. An insert panel 134 can extend from the spacer panel 132 along the first direction D1 and can define the head end E1 of the board 108 when the board 108 is in the fully open configuration shown in FIG. 25.

Figure 26:
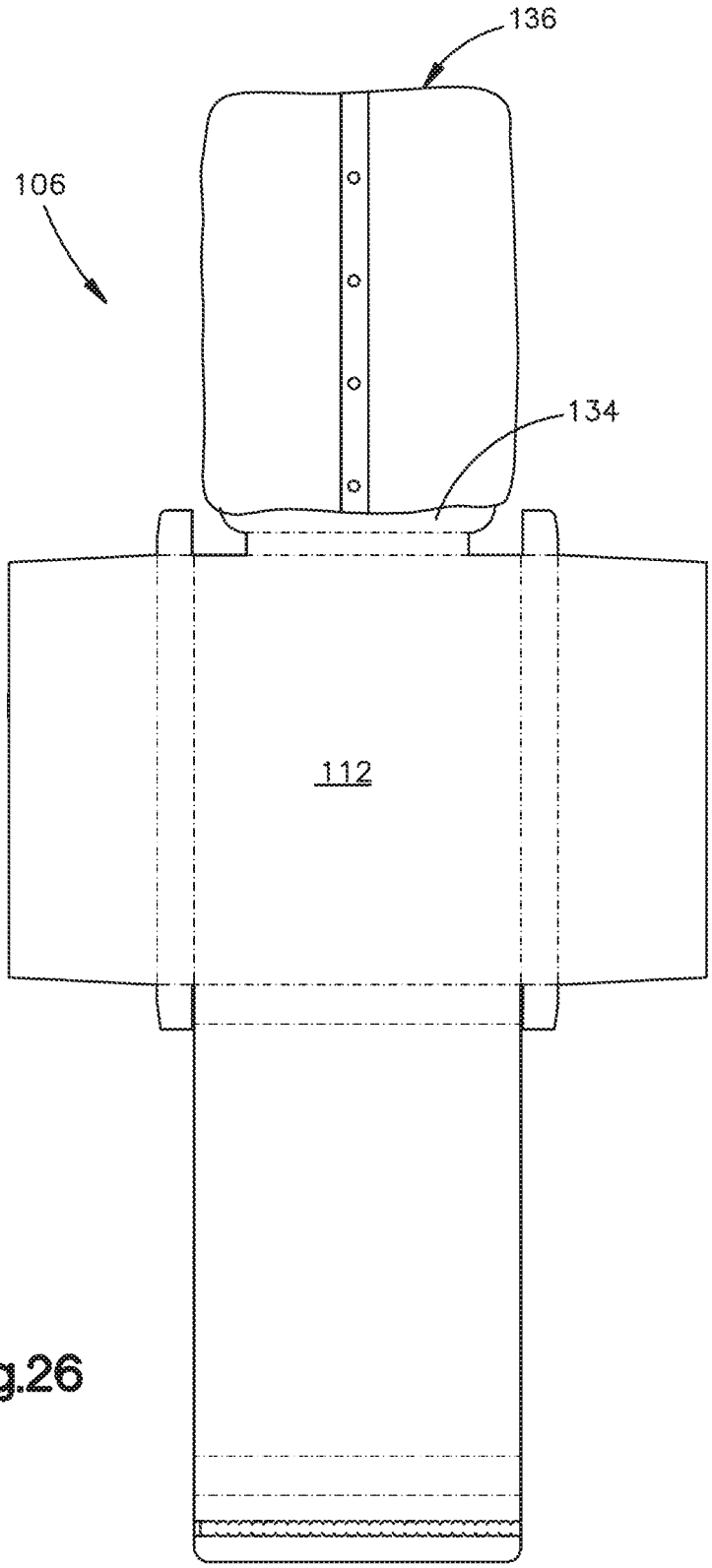
FIG. 26 shows a plan view of a packaging assembly that includes the container of FIG. 25 inserted within a garment.

Referring now to FIG. 26, the insert panel 134 can be configured to be inserted within a garment, such as a pre-folded shirt 136. In particular, the insert panel 134 can be inserted between the back and the sleeves of the pre-folded shirt. In some embodiments, the shirt 136 can be folded around the insert panel 134 so that the insert panel 134 is positioned between the back and the sleeves of the shirt 136. In other embodiments (not shown), the insert panel 134 can be sized to extend through the collar of the shirt 136.

Figure 27:
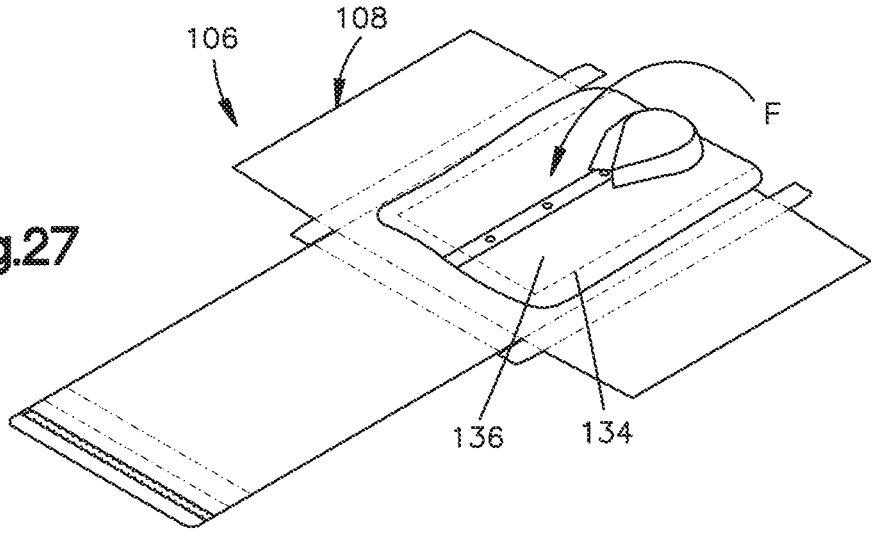
FIG. 27 shows a perspective view of the packaging assembly of FIG. 26, wherein the container is folded to a first partially folded configuration.

Referring now to FIG. 27, the container 106 can be folded from the open configuration to a first partially folded configuration by folding the insert panel 134, which carries the shirt 136, over the first base panel 112 along the first direction D1, which fold is indicated by arrow F in FIG. 27. Alternatively, the insert panel 134 can be inserted within the shirt 136 after the insert panel 134 is folded over the first base panel 112. The spacer panel 132 can provide the insert panel 134 and the shirt 136 with a desired clearance over the first base panel 112 along a third or vertical direction D3. The spacer panel 132 and the insert panel 134 can also be sized and configured to maintain the longitudinal and lateral position of the shirt 136 with respect to the first base panel 112 to ensure that the shirt is optimally presented to the customer upon opening the container 106. Such maintenance of the position of the shirt 136 can also prevent the shirt 136 from sliding or bunching within the enclosed container 106. The first base panel 112 can be sized so as to provide at least some degree of clearance between the shirt 136 and the sidewalls 116, 118, 120, 122 of the enclosed container 106.

Figure 28:
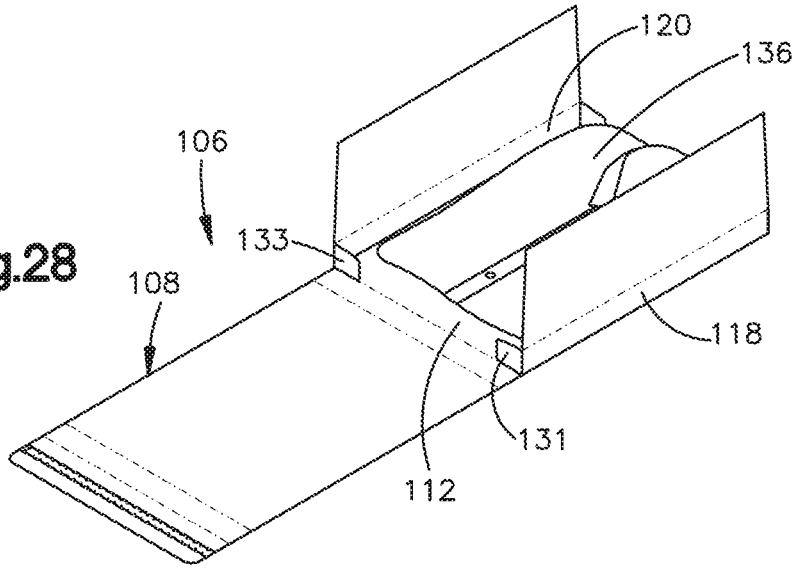
FIG. 28 shows a perspective view of the packaging assembly of FIG. 26, wherein the container is folded to a second partially folded configuration.
Figure 29:
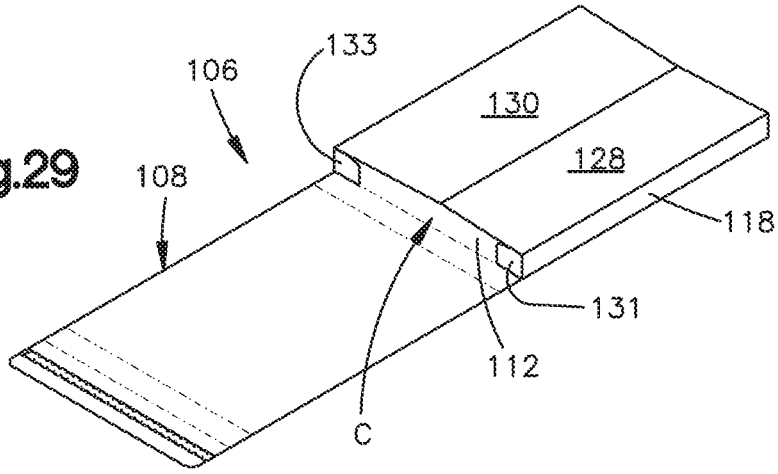
FIG. 29 shows a perspective view of the packaging assembly of FIG. 26, wherein the container is folded to a third partially folded configuration.

Referring now to FIG. 28, the container 106 can be folded to a second partially folded configuration by folding the second and third sidewall panels at orthogonal orientations relative to the first base panel 112. The support tabs 131, 133 can also each be folded inward so as to extend along the second direction D3 along a periphery of the first base panel 112. As shown in FIG. 29, the container 106 can be folded to a third partially folded configuration by folding the first and second fold-over panels 128, 130 over the shirt 136 and the first base panel 112. The support tabs 131, 133 can provide vertical support to the fold-over panels 128, 130. In this manner, the first base panel 112 and the sidewall panels 116, 118, 120, 122 can define a compartment C having dimensions tailored to protectively enclose the shirt 136 while reducing excess vertical space of the container, which reduces the overall volume of the container, which allows more containers 106 to be fit into a storage space in a fulfillment center or a delivery vehicle.

Figure 30:
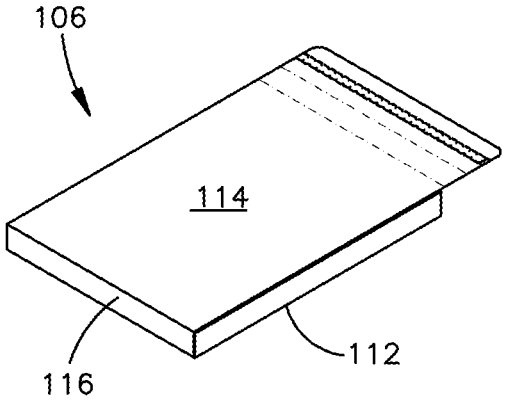
FIG. 30 shows a perspective view of the packaging assembly of FIG. 26, wherein the container is folded to a fourth partially folded configuration.
Figure 31:
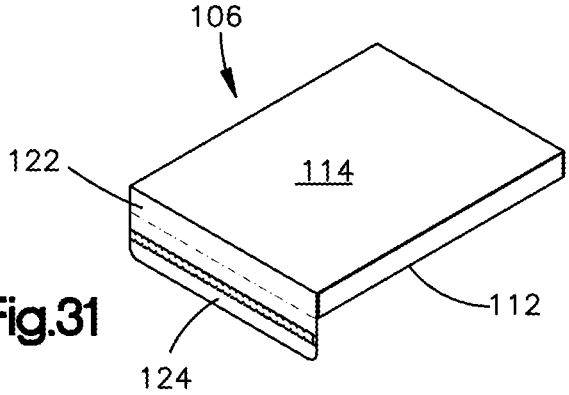
FIG. 31 shows a perspective view of the packaging assembly of FIG. 26, wherein the container is folded to a fifth partially folded configuration.
Figure 32:
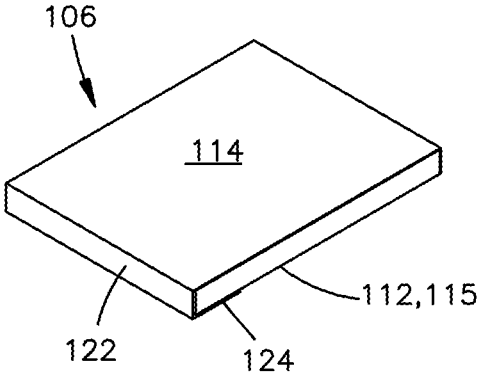
FIG. 32 shows a perspective view of the packaging assembly of FIG. 26, wherein the container is folded to a fully enclosed configuration.

Referring now to FIGS. 30 through 32, the container 106 can be folded to a fourth partially folded configuration (FIG. 30) by folding the first sidewall panel 116 at an orthogonal orientation relative to the first base panel 112 so as to abut a tab of each pair 131, 133 of support tabs and additionally folding the second base panel 114 over the first base panel 112 so as to abut the fold-over panels 128, 130. As shown in FIG. 31, the container 106 can be folded to a fifth partially folded configuration by folding the fourth sidewall panel 122 down to an orthogonal orientation relative to the first base panel 112 so as to abut a tab of each pair 131, 133 of support tabs. As shown in FIG. 32, the container 106 can be folded to a fully enclosed configuration and sealed by removing the covering from the second adhesive strip 125 (FIG. 25) and folding the closure panel 124 upward against an exterior surface 115 of the first base panel 112 that is spaced from the interior surface 113 (FIG. 25) thereof along the third direction D3. In the fully enclosed configuration, the second adhesive strip 125 can adhere to the exterior surface 125 of the first base panel 112. To open the container 106, the perforated tear-away strip 126 can be pulled away and the second base surface 114 can be unfolded. For return shipping, the covering over the second adhesive strip 127 can be removed, and the container can be substantially re-configured into the fully enclosed configuration, and the second adhesive strip 127 can be adhered to the exterior surface 115 of the first base surface 112.

It is to be appreciated that at least some of the panels, such as the sidewall panels 116, 118, 120, 122, for example, can define scoring or other features that provide such panels with a degree of size adjustability so as to allow the container 106 to achieve an adjustable fit to the garment folded within.

Figures 33, 34:
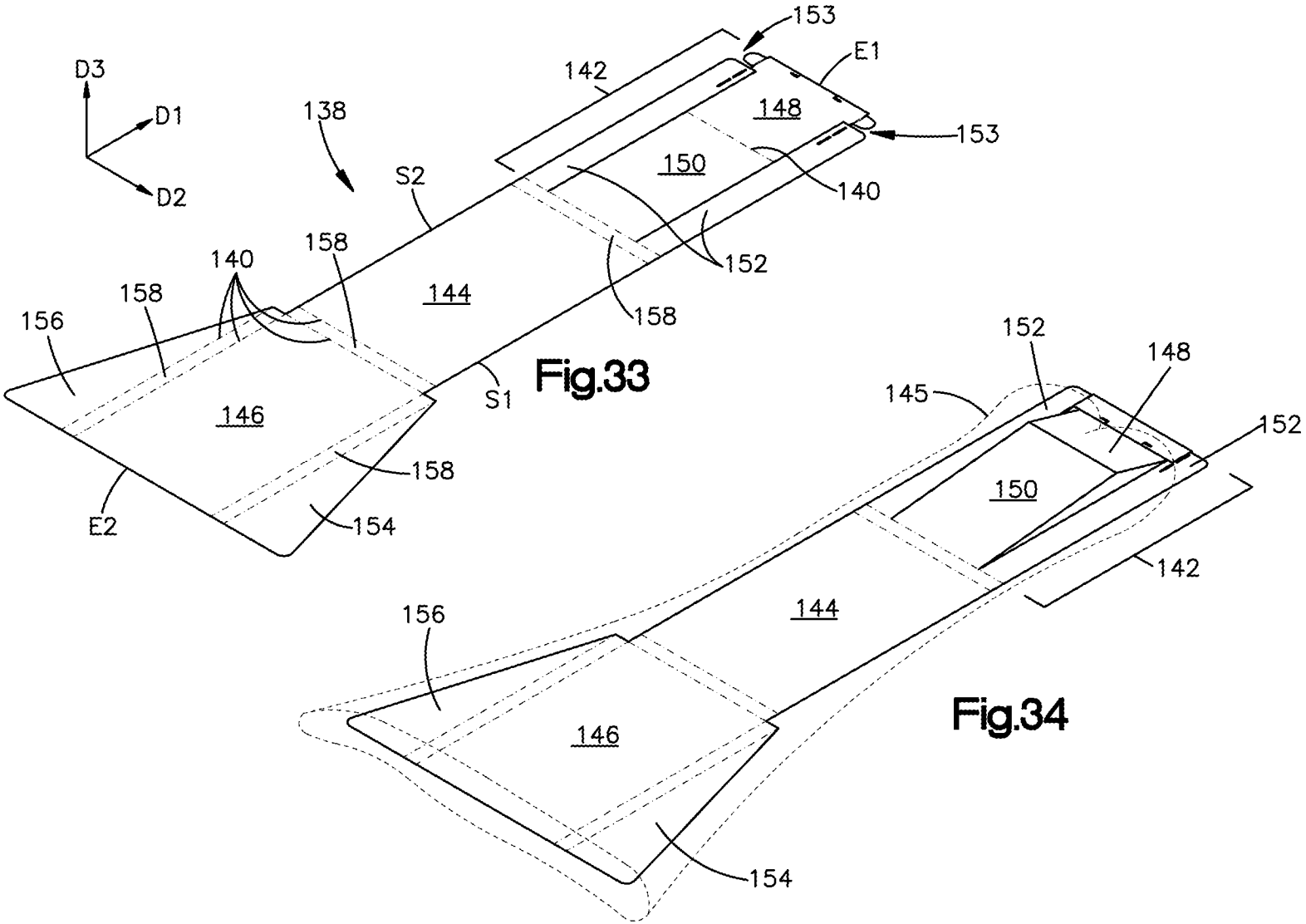
FIG. 33 shows a perspective view of an insert for positioning a garment within a container according to an embodiment.
FIG. 34 shows a perspective view of the insert of FIG. 33 inserted within a garment.

Referring now to FIGS. 33 and 34, a foldable insert 138 for a package, such as a SIOC package, is shown. The foldable insert 138 can extend along a first or longitudinal direction D1 between a head end E1 and a foot end E2 and can extend along a second or lateral direction D2 between first and second lateral sides S1, S2. The insert 138 can be symmetrical with respect to the second direction D2, although other configurations are possible. The insert 138 preferably includes a single piece of material that defines a plurality of joined panels that are foldable relative to one another along pre-formed crease lines 140 so as to reconfigure the insert 138 from a substantially flat or fully open configuration to a fully folded configuration that is ready for insertion in an outer box. The insert 138 can be formed of a plastic material, paperboard, corrugated board, or other materials. The material can be selected to have a degree of flexibility during folding while maintaining the rigidity necessary to support the garment. Additionally, the insert 138 is preferably formed of a material that will not leave particulate materials or board dust on the garment.

As shown in FIG. 34, the particular insert 138 of the present embodiment can be configured to insert within a floor-length dress or gown 145, although the insert 138 can be alternatively designed to fit other types of garments. With continued reference to FIG. 33, the insert 138 can include bodice panel 142, a mid panel 144, and a foot panel 146 extending sequentially along the first direction from the head end E1 to the foot end E2. The bodice panel 142 can include a first portion 148, a second portion 150, and a pair of longitudinally extending arms 152 positioned on opposite lateral sides of the first and second portions 148, 150. The first portion 148 and the arms 152 can define corresponding mating features, such as adjustable tab and slot fasteners 153, that allow the first portion 148 to be adjusted toward the foot end E2 of the insert, which causes the first and second portions to be inclined upward toward a crease line 140 therebetween so as to generally approximate a bust to support a bodice region of the dress. The insert 138 can include a pair of side panels 154, 156 spaced on opposite lateral sides of the foot panel 146. Spacer panels 158 can be positioned between the bodice and mid panels 142, 144, the mid and foot panels 144, 146, and between the foot panel 146 and each of the side panels 154, 156 so as to provide a measure of clearance between at least portions of the various panels along a third or vertical direction D3 when the insert 138 is folded so as to reduce unwanted creases in the dress and avoid crushing or otherwise harming the dress.

The panels of the insert 138 can be configured to maintain a desired fold of the garment 145, such as by ensuring that various portions of the garment 145 remain in their intended position relative to one another while folded with the insert 138. Thus, certain fragile portions of the garment, such as the bodice, the skirt, and any sequins thereof, for example, can remain separated from one another without being crushed, scraped, snagged, misshaped, or otherwise damaged by other portions of the garment 145, by the insert 138 itself, or by an outer container in which the insert 138 and garment 145 may be placed. The panels also add form to the dress, even while folded.

Figure 35:
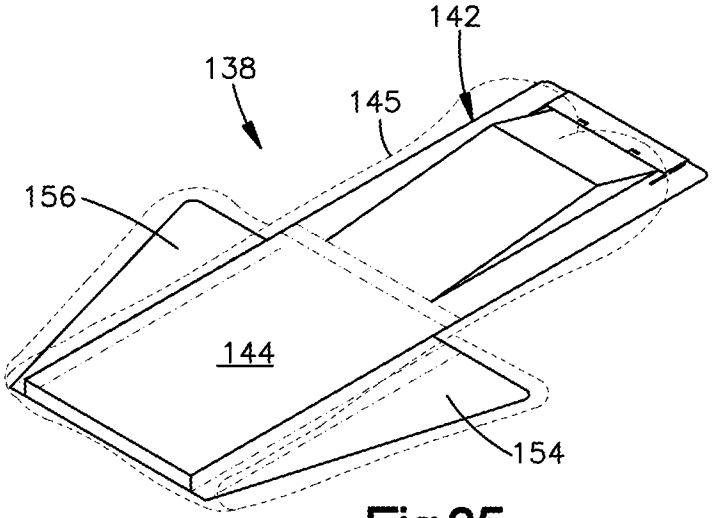
FIG. 35 shows a perspective view of the insert and garment of FIG. 34 folded into a first partially folded configuration.
Figure 36:
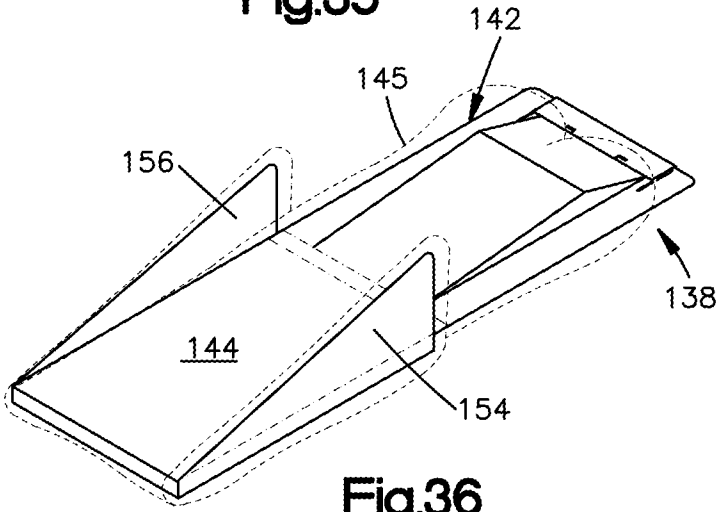
FIG. 36 shows a perspective view of the insert and garment of FIG. 34 folded into a second partially folded configuration.
Figure 37:
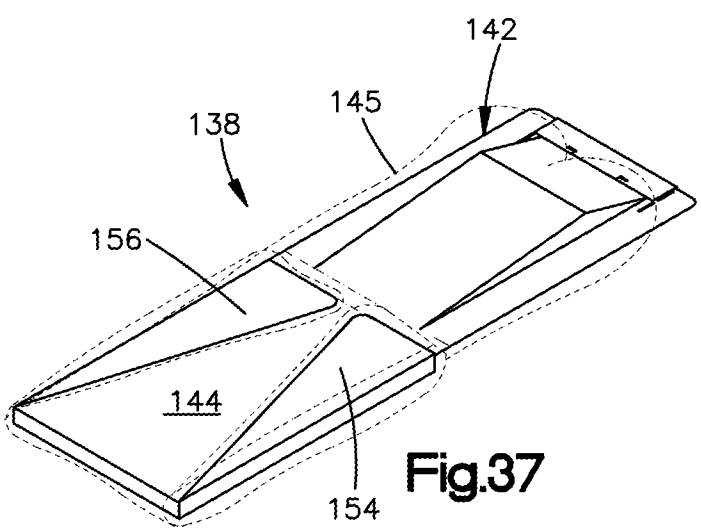
FIG. 37 shows a perspective view of the insert and garment of FIG. 34 folded into a third partially folded configuration.
Figure 38:
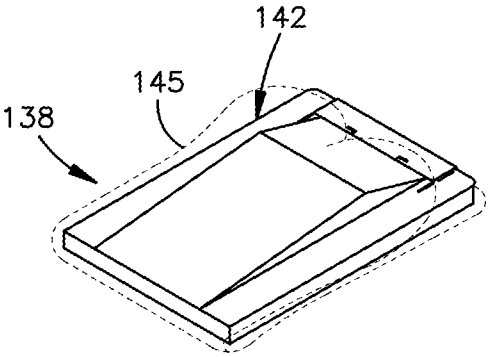
FIG. 38 shows a perspective view of the insert and garment of FIG. 34 folded into a fully folded configuration.
Figure 39:
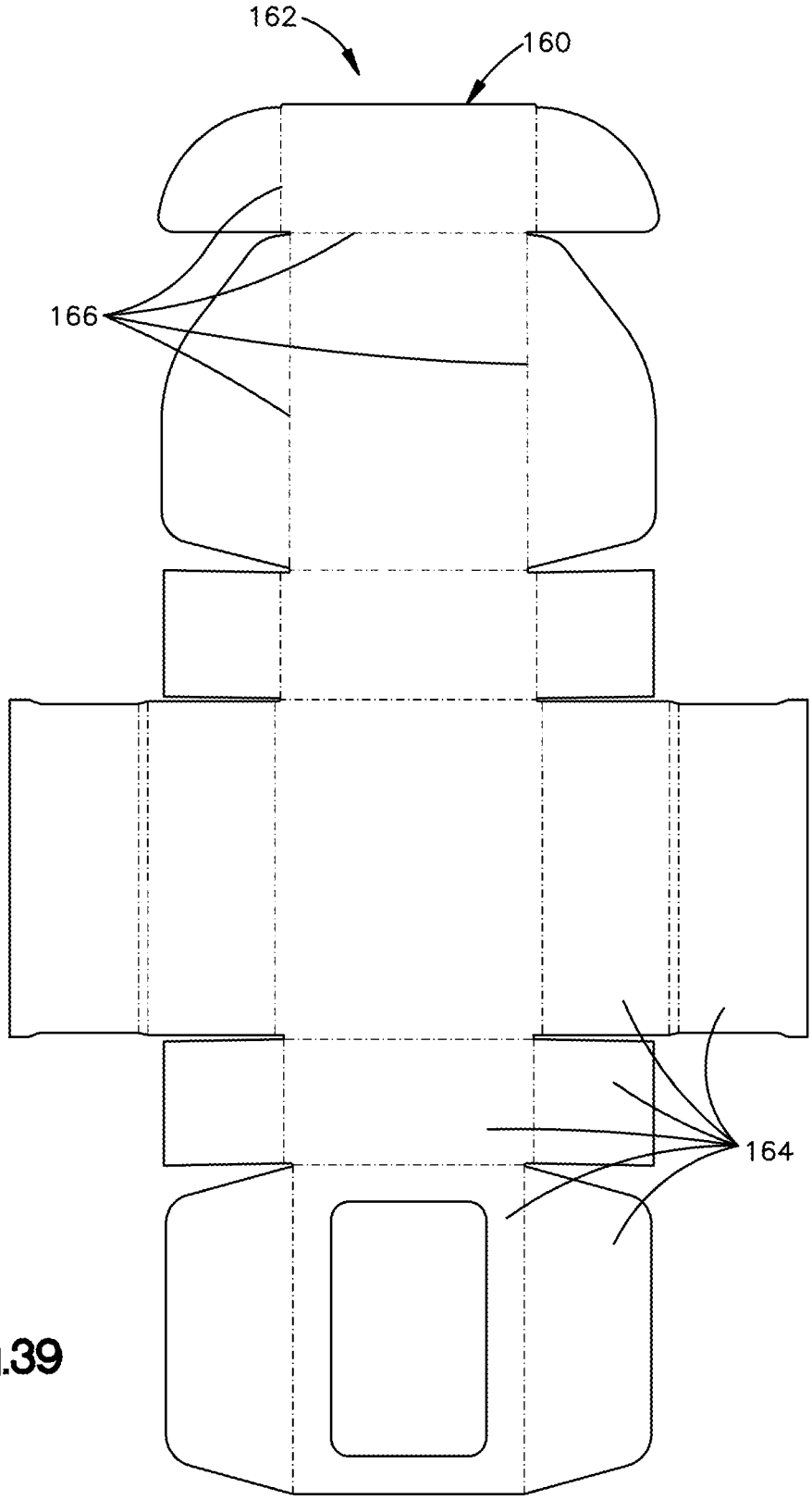
FIG. 39 shows a plan view of an outer container in an initial, open configuration, wherein the outer container is configured to enclose the folded insert and garment of FIG. 38.
Figure 40:
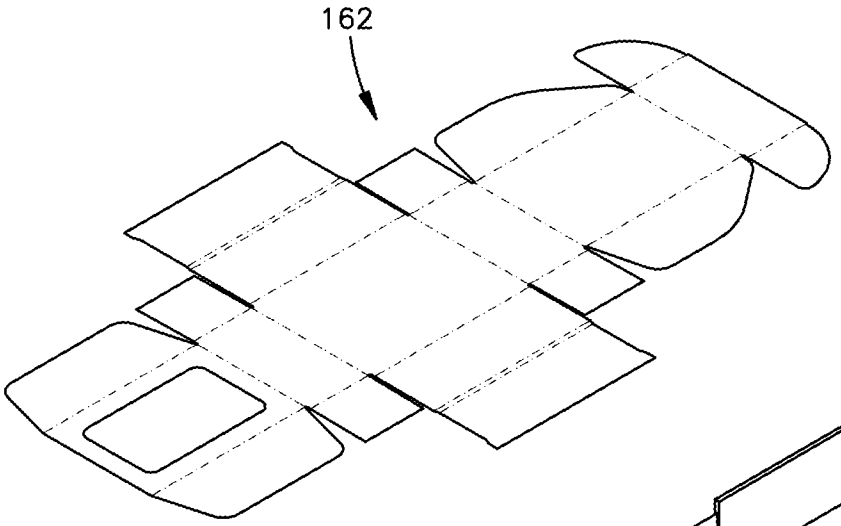
FIG. 40 shows a perspective view of the outer container of FIG. 39 in a first partially folded configuration.
Figure 41:
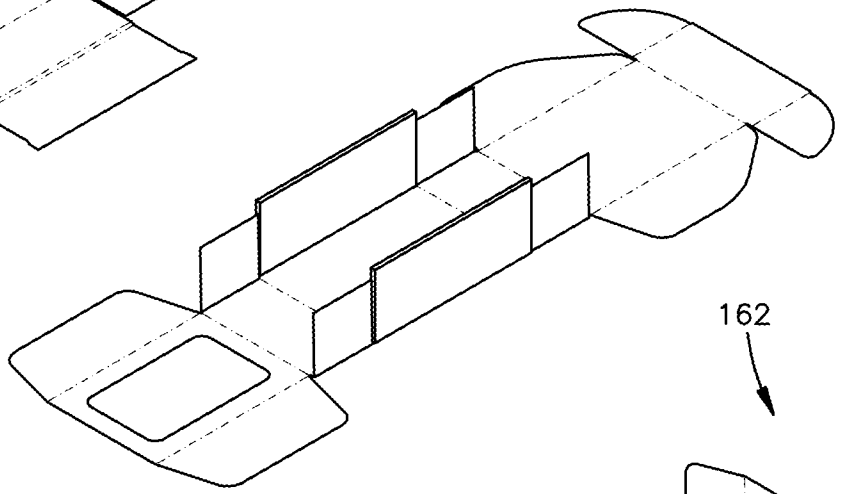
FIG. 41 shows a perspective view of the outer container of FIG. 39 in a second partially folded configuration.
Figure 42:
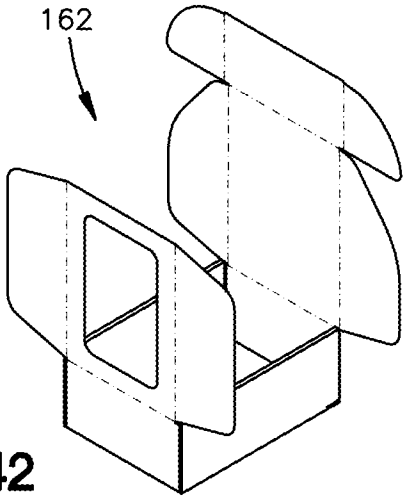
FIG. 42 shows a perspective view of the outer container of FIG. 39 in a third partially folded configuration.
Figure 44:
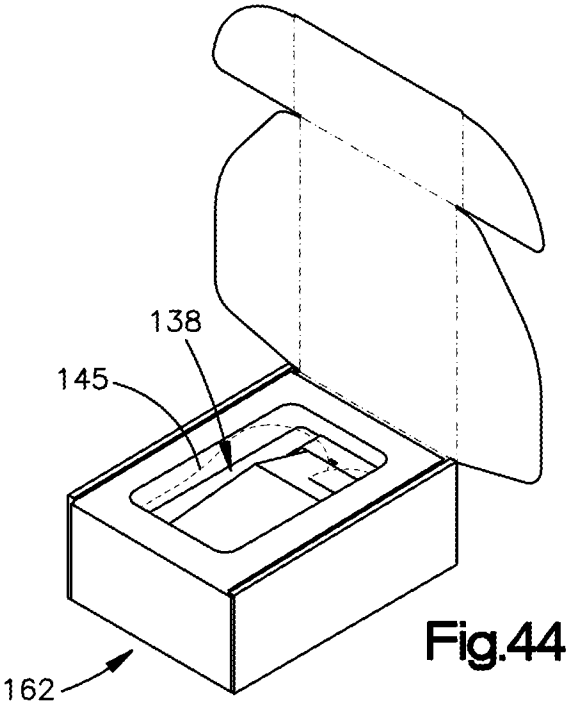
FIG. 44 shows a perspective view of the folded insert and garment of FIG. 38 located within the outer container of FIG. 43 in a fifth partially folded configuration.
Figure 45:
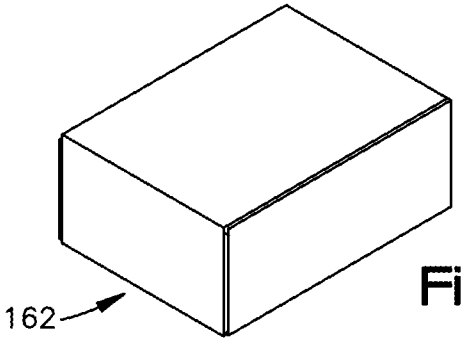
FIG. 45 shows a perspective view of the outer container of FIG. 43 in a fully enclosed configuration.
Figure 43:
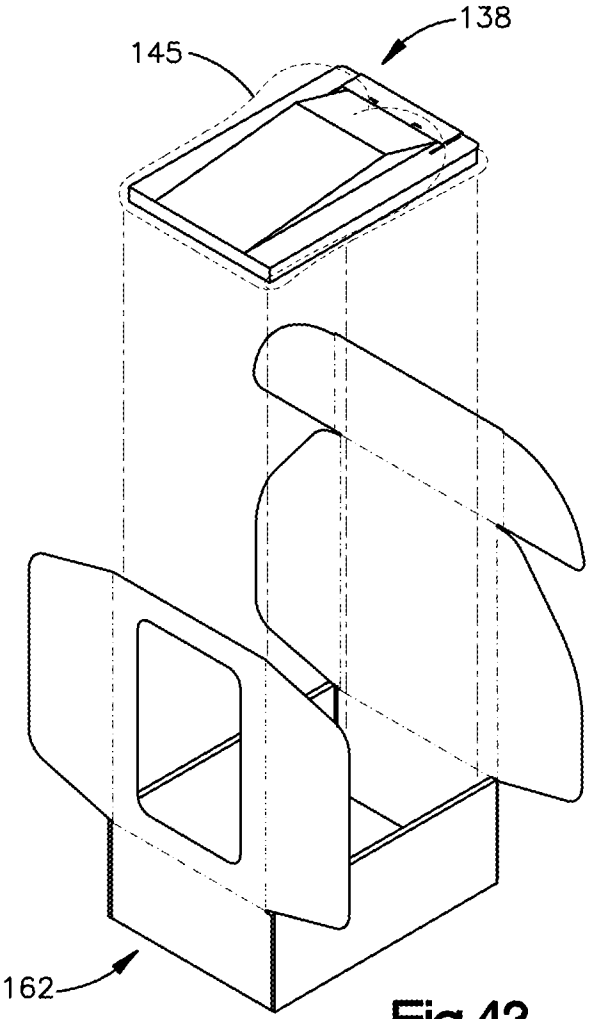
FIG. 43 shows a perspective view of the outer container of FIG. 39 in a fourth partially folded configuration that is ready to receive the folded insert and garment of FIG. 38.

Referring now to FIGS. 35 through 38, example folding sequence is illustrated according to a non-limiting embodiment of the present disclosure. As shown in FIG. 35, the foot panel 146 can be folded underneath the mid panel 144. As shown in FIGS. 36 and 37, the side panels 154, 156 can be folded up and over the mid panel 144, so that the mid panel 144 is positioned between the side panels 154, 156 and the foot panel 146 with respect to the third direction D3. As shown in FIG. 38, the mid panel 144, along with the side and foot panels 154, 156, 146, can be folded underneath the bodice panel 142.

FIGS. 39 through 45 illustrates a board 160 of an outerbox 162 for carrying the insert 138. In a similar manner as set forth above, the outer box board 160 can define a plurality of joined panels 164 that are foldable relative to one another along pre-formed crease lines 166 so as to reconfigure the outerbox 162 from the fully open configuration (FIGS. 39 and 40) to a configuration (FIGS. 42 and 43) that is ready to receive the insert 138. After placing the insert 138 in the outerbox 162, final folds can be made to the outerbox 162 so as to place it in a fully enclosed configuration.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated.

Unless explicitly stated otherwise, each numerical value and range should be interpreted as being approximate as if the word "about" or "approximately" preceded the value or range.

It should be understood that the steps of exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

What is claimed is:

1. A container, comprising:

a single piece of material having a plurality of foldable panels that are foldable from a flat configuration into an enclosed configuration, the plurality of foldable panels including:

a first base panel configured to support a garment;

an insert panel extending from the first base panel, the insert panel configured to be inserted within a portion of the garment, the insert panel foldable relative to the first base panel so as to position the garment over the first base panel;

a plurality of sidewall panels each foldable relative to the first base panel so as to form sidewalls of the container, wherein the plurality of sidewall panels consists essentially of first, second, third, and fourth sidewall panels;

a second base panel extending from the first sidewall panel, the second base panel foldable relative to the first base panel so as to overlay the first base panel, wherein, when the container in the flat configuration, (1) the first sidewall panel is positioned between the first and second base panels along a first direction, (2) the second base panel is positioned between the first and fourth sidewall panels along the first direction, and (3) the second and the third sidewall panels each extend entirely from opposite sides of the first base panel along a second direction that is offset from the first direction; and a closure panel extending from one of the plurality of foldable panels, the closure panel foldable relative to at least one of the plurality of sidewall panels, the closure panel carrying a fastener for fastening to at least another one other of the plurality of foldable panels so as to maintain the container in the enclosed configuration.

2. The container of claim 1, wherein the first sidewall panel shares a common crease line with the first base panel and shares another common crease line with the second base panel.

3. The container of claim 2, wherein the plurality of foldable panels further comprises:

a first fold-over panel extending the second sidewall panel; and a second fold-over panel extending from the third sidewall panel, wherein, when the container in the flat configuration, the first and second fold-over panels each extend away from the first base panel along the second direction, and wherein the first and second fold-over panels are each foldable over the insert panel, the garment, and the first base panel.

4. The container of claim 3, wherein the second base panel is foldable over the first and second fold-over panels.

5. The container of claim 4, wherein the closure panel extends from the fourth sidewall panel such that the fourth sidewall panel is positioned between the closure panel and the second base panel along the first direction when the container in the flat configuration.

6. The container of claim 5, wherein the first base panel defines an interior surface and an exterior surface opposite the interior surface along a third direction that is offset from the first and second directions, and the fastener is configured to attach to the exterior surface of the first base panel when the container is in the enclosed configuration.

7. The container of claim 4, wherein:

each of the second and third sidewall panels defines a first end and a second end opposite the first end with respect to the first direction; and the container further comprises:

first and second tabs extending from the first and second ends, respectively, of the second sidewall panel along the first direction; and third and fourth tabs extending from the first and second ends, respectively, of the third sidewall panel along the second direction, wherein the first and second tabs are foldable relative to the second sidewall panel and the third and fourth tabs are foldable relative to the third sidewall panel so that each of the first, second, third, and fourth tabs extends along the second direction along a periphery of the first base panel when the container is in the enclosed configuration; and wherein the first and third tabs are configured to abut the fourth sidewall and the second and fourth tabs are configured to abut the first sidewall when the container is in the enclosed configuration.

8. The container of claim 1, wherein the plurality of foldable panels includes a spacer panel extending between the first base panel and the insert panel, wherein the spacer panel is foldable relative to the first base panel and the insert panel, and the spacer panel is configured to provide a gap between the first base panel and at least a portion of the insert panel when the container is in the fully enclosed configuration.

9. The container of claim 1, wherein the fastener comprises an adhesive strip extending along the second direction.

10. The container of claim 9, wherein the adhesive strip is a first adhesive strip, the closure panel further comprises a second adhesive strip extending along the second direction, the second adhesive strip is spaced from the first adhesive strip along the first direction.

11. The container of claim 10, wherein the closure panel further comprises a perforated tear-away strip traversing the closure panel along the second direction and being located between the first and second adhesive strips, and the perforated tear-away strip is configured to detach the first adhesive strip from the closure panel, such that the second adhesive strip is fastenable to the at least another one other of the plurality of foldable panels so as to maintain the container in the enclosed configuration for return shipping.

12. The container of claim 10, wherein the closure panel further comprises removable coverings that cover the first and second adhesive strips when the container is in the flat configuration.

13. A method of using the container of claim 1, the method comprising:

positioning the insert panel within a portion of the garment;

folding the insert panel, with the garment attached thereto, about a crease-line so that the insert panel and the garment each overlay the first base panel with respect to a vertical direction;

folding the first sidewall panel about a crease line between the first sidewall panel and the first base panel so that the first sidewall panels extends upward from the first base panel along the vertical direction;

folding the second and third sidewall panels about crease-lines between the first base panel and the second and third sidewall panels, respectively, so that each of the second and third sidewall panels extends upward from the first base panel along the vertical direction;

folding the second base panel about a crease line between the second base panel and the first sidewall panel so that the second base panel overlies the garment, the insert panel, and the first base panel, wherein each crease line is pre-formed in the single piece of material.

14. The method of claim 13, further comprising folding the fourth sidewall panel about a crease line between the fourth sidewall panel and the second base panel so that the fourth sidewall panel 1) extends along the vertical direction from the second base panel to the first base panel, and 2) is positioned on a side of the first base panel opposite the first sidewall panel.

15. The method of claim 14, further comprising folding the closure panel about a crease line between the closure panel and the fourth sidewall panel so that the closure panel abuts an exterior surface of the first base panel.

16. The method of claim 15, further comprising attaching the closure panel to the exterior surface of the first base panel in a manner sealing the container for shipping.

17. The method of claim 14, further comprising:

folding a first pair of tabs extending from the second sidewall panel about respective crease lines so that each of the first pair of tabs extends along a periphery of the first base panel; and folding a second pair of tabs extending from the third sidewall panel about respective crease lines so that each of the second pair of tabs extends along a periphery of the first base panel, wherein the first and second pairs of tabs are positioned inward from and abut the first and fourth sidewall panels at the conclusion of folding the fourth sidewall panel about the crease line between the fourth sidewall panel and the second base panel.

18. The method of claim 13, further comprising, prior to the first folding step, folding a spacer panel that extends between the first base panel and the insert panel about a crease line between the spacer panel and the first base panel so that the space panel at least partially extends upward from the first base panel along the vertical direction.

* * * * *